US010307891B2

(12) United States Patent
Daniels et al.

(10) Patent No.: US 10,307,891 B2
(45) Date of Patent: Jun. 4, 2019

(54) ATTACK INSERTS WITH DIFFERING SURFACE FINISHES, ASSEMBLIES, SYSTEMS INCLUDING SAME, AND RELATED METHODS

(71) Applicant: US Synthetic Corporation, Orem, UT (US)

(72) Inventors: Grant Kyle Daniels, Spanish Fork, UT (US); Jeremy Dane Wood, Lehi, UT (US); Jarid Lynn Spencer, Payson, UT (US); John Christian Marx, Springville, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 69 days.

(21) Appl. No.: 15/232,780

(22) Filed: Aug. 9, 2016

(65) Prior Publication Data

US 2017/0043452 A1 Feb. 16, 2017

Related U.S. Application Data

(60) Provisional application No. 62/204,336, filed on Aug. 12, 2015.

(51) Int. Cl.
*B24D 3/02* (2006.01)
*B24D 18/00* (2006.01)
(Continued)

(52) U.S. Cl.
CPC ..... *B24D 18/00* (2013.01); *B24D 18/0009* (2013.01); *E21B 10/5673* (2013.01); *E21C 35/183* (2013.01); *E21C 2035/1816* (2013.01)

(58) Field of Classification Search
USPC ..... 51/307, 293, 309
See application file for complete search history.

(56) References Cited

U.S. PATENT DOCUMENTS 3,670,380 A 6/1972 Moore
4,109,737 A 8/1978 Bovenkerk
(Continued)

FOREIGN PATENT DOCUMENTS

DE 4141900 A1 6/1993
DE 4240053 A1 6/1993
(Continued)

OTHER PUBLICATIONS

Andersen, E.E., et al., "PDC-Bit Performance Under Simulated Borehole Conditions", (SPE Paper No. 20412) SPE Drilling & Completion, Sep. 1993, pp. 184-188.
(Continued)

*Primary Examiner* — James E McDonough
(74) *Attorney, Agent, or Firm* — Fisherbroyles, LLP

(57) ABSTRACT

A superabrasive element includes a substrate and a superabrasive table bonded to the substrate, the superabrasive table including a polished surface having a polished finish, the polished surface extending over at least a central, apical region of the superabrasive table, and an unpolished surface including an unpolished finish, the unpolished surface surrounding a majority of the polished surface. A method of manufacturing a superabrasive element includes providing a superabrasive element having a substrate and a superabrasive table bonded to the substrate and polishing at least a central, apical region of the superabrasive table to form a polished surface, without polishing an unpolished surface of the superabrasive table, the unpolished surface surrounding a majority of the polished surface.

14 Claims, 19 Drawing Sheets

(51) Int. Cl.

| | |
|---|---|
| ***E21B 10/567*** | (2006.01) |
| ***E21C 35/183*** | (2006.01) |
| *B24D 3/00* | (2006.01) |
| *B24D 11/00* | (2006.01) |
| *C09K 3/14* | (2006.01) |
| *E21C 35/18* | (2006.01) |

(56) References Cited

U.S. PATENT DOCUMENTS

| | | | |
|---|---|---|---|
| 4,211,508 | A | 7/1980 | Dill |
| 4,478,297 | A | 10/1984 | Radtke |
| 4,525,179 | A | 6/1985 | Gigl |
| 4,533,004 | A | 8/1985 | Ecer |
| 4,539,018 | A | 9/1985 | Whanger |
| 4,566,426 | A | 1/1986 | Schleich |
| 4,604,106 | A | 8/1986 | Hall |
| 4,606,418 | A | 8/1986 | Thompson |
| 4,629,373 | A | 12/1986 | Hall |
| 4,646,857 | A | 3/1987 | Thompson |
| 4,662,348 | A | 5/1987 | Hall |
| 4,693,035 | A | 9/1987 | Doyle |
| 4,694,918 | A | 9/1987 | Hall |
| 4,784,023 | A | 11/1988 | Dennis |
| 4,805,586 | A | 2/1989 | Borse |
| 4,852,671 | A | 8/1989 | Southland |
| 4,858,707 | A | 8/1989 | Jones |
| 4,872,520 | A | 10/1989 | Nelson |
| 4,883,132 | A | 11/1989 | Tibbitts |
| 4,884,476 | A | 12/1989 | Okuzumi |
| 4,913,244 | A | 4/1990 | Trujillo |
| 4,913,247 | A | 4/1990 | Jones |
| 4,954,139 | A | 9/1990 | Cerutti |
| 4,976,324 | A | 12/1990 | Tibbitts |
| 4,984,642 | A | 1/1991 | Renard |
| 4,988,421 | A | 1/1991 | Drawl |
| 4,992,082 | A | 2/1991 | Drawl |
| 4,997,049 | A | 3/1991 | Tank |
| 5,011,509 | A | 4/1991 | Frushour |
| 5,011,514 | A | 4/1991 | Cho |
| 5,011,515 | A | 4/1991 | Frushour |
| 5,025,874 | A | 6/1991 | Barr |
| 5,035,771 | A | 7/1991 | Borse |
| 5,037,451 | A | 8/1991 | Burnand |
| 5,054,246 | A | 10/1991 | Phaal |
| 5,115,873 | A | 5/1992 | Pastusek |
| 5,120,327 | A | 6/1992 | Dennis |
| 5,135,061 | A | 8/1992 | Newton |
| 5,154,245 | A | 10/1992 | Waldenstrom |
| 5,172,778 | A | 12/1992 | Tibbitts |
| 5,184,433 | A | 2/1993 | Maack |
| 5,215,415 | A | 6/1993 | Fukuoka |
| 5,217,081 | A | 6/1993 | Waldenstrom |
| 5,264,283 | A | 11/1993 | Waldenstrom |
| 5,304,342 | A | 4/1994 | Hall, Jr. |
| 5,335,738 | A | 8/1994 | Waldenstrom |
| 5,370,195 | A | 12/1994 | Keshavan |
| 5,379,854 | A | 1/1995 | Dennis |
| 5,447,208 | A | 9/1995 | Lund |
| 5,460,233 | A | 10/1995 | Meany |
| 5,469,927 | A | 11/1995 | Griffin |
| 5,504,303 | A | 4/1996 | Nagy |
| 5,544,713 | A | 8/1996 | Dennis |
| 5,624,068 | A | 4/1997 | Waldenstrom |
| 5,648,119 | A | 7/1997 | Grab |
| 5,653,300 | A | 8/1997 | Lund |
| 5,669,271 | A | 9/1997 | Griffin |
| 5,706,906 | A | 1/1998 | Jurewicz |
| 5,722,499 | A | 3/1998 | Nguyen |
| 5,823,277 | A | 10/1998 | Delwiche |
| 5,944,129 | A | 8/1999 | Jensen |
| 5,967,250 | A | 10/1999 | Lund |
| 5,992,549 | A | 11/1999 | Fuller |
| 6,145,608 | A | 11/2000 | Lund |
| 2014/0246253 | A1* | 9/2014 | Patel ..... E21B 10/5673 175/430 |

FOREIGN PATENT DOCUMENTS

| | | |
|---|---|---|
| EP | 0149530 A3 | 7/1985 |
| EP | 0298729 A1 | 1/1989 |
| EP | 0322214 B1 | 6/1989 |
| EP | 0480394 A2 | 4/1992 |
| EP | 0541071 A1 | 5/1993 |

OTHER PUBLICATIONS

Clark, D.A., et al., Comparison of Laboratory and Field Data for a PDC Bit, (SPE/IADC Paper No. 13459) SPE/IADC 1985 Drilling Conference, pp. 323-325.

A letter dated Nov. 15, 1995 from Bill Short of Bit & Tool to David Hail of Novatek.

Letter with attachments from Mark R. Benenti of Hommell America Inc. to Gerald Angst of Hycalog, dated Dec. 18, 1995, 8 pages.

Davis, J.R., "Technical Brief 51: Superabrasives", ASM Materials Engineering Dictionary, p. 465, 1992.

Hemphill, Terry, et al., Effects of PDC-Bit Selection and Mud Chemistry on Drilling Rates in Shale, (SPE Paper No. 22579) SPE Drilling & Completion, Sep. 1994, pp. 176-184.

Hibbs, L.E., et al., "Wear Mechanisms for Polycrystalline Diamond Compacts as Utilized for Drilling in Geothermal Environments", General Electric Company, Corporate Research and Development, Contract Period Nov. 1979 to Sep. 1982, pp. 89-99.

Kuru, E., et al., "An Experimental Study of Sliding Friction Between PDC Drill Cutters and Rocks", Int. J. Rock Mech. Min. Sci. & Geomech. Abstr., vol. 32, No. 3, pp. 227-283, 1995.

Pessier, R.C., et al., "Quantifying Common Drilling Problems With Mechanical Specific Energy and a Bit-Specific Coeffcient of Sliding Friction", (SPE Paper No. 24584) Society of Petroleum Engineers Inc., 1992, pp. 373-388.

Schey, John A., "Tribology in Metalworking—Friction, Lubrication and Wear", American Society for Metals, 1983, pp. 573-616.

Simon, R., "Energy Balance in Rock Drilling", (SPE Paper No. 499) Society of Petroleum Engineers Journal, Dec. 1963, pp. 298-306.

Smith, R.H., et al., "Drilling Plastics Formations Using Highly Polished PDC Cutters", (SPE Paper No. 30476) Society of Petroleum Engineers, Inc., 1995, pp. 29-44.

Teale, R., "The Concept of Specific Energy in Rock Drilling", Int. J. Rock Mech. Mining Set., vol. 2, 1965, pp. 57-73.

Wampler, Charles, et al., "Methodology for selecting PDC bits cuts drilling costs", Oil & Gas Journal, Jan. 15, 1990, pp. 39-44.

Warren, T.M., et al., "Bottomhold Stress Factors Affecting Drilling Rate at Depth", Journal of Petroleum Technology, Aug. 1985, pp. 1523-1533.

Warren, T.M., et al., "Laboratory Drilling Performance of PDC Bits", (SPE Paper No. 15617) SPE Drilling Engineering, Jun. 1988, pp. 125-135.

Wilks, John, et al., "Properties and Applications of Diamond", Butterworth-Heinemann Ltd., 1991, pp. 290-309.

* cited by examiner

ATTACK INSERTS WITH DIFFERING SURFACE FINISHES, ASSEMBLIES, SYSTEMS INCLUDING SAME, AND RELATED METHODS

CROSS REFERENCE TO RELATED APPLICATIONS

This application is a non-provisional utility application which claims the benefit of U.S. Provisional Patent Application No. 62/204,336, titled "ATTACK INSERTS WITH DIFFERING SURFACE FINISHES, ASSEMBLIES, SYSTEMS INCLUDING SAME, AND RELATED METHODS" and filed 12 Aug. 2015, the disclosure of which is hereby incorporated, in its entirety, by this reference.

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive diamond layer commonly referred to as a diamond table. The diamond table may be formed and bonded to a substrate using a high-pressure, high-temperature ("HPHT") process. The PDC cutting element may also be brazed directly into a preformed pocket, socket, or other receptacle defined in the bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle defined in the bit body.

Conventional PDCs are normally fabricated by placing a cemented carbide substrate into a container with a volume of diamond particles positioned adjacent to the cemented carbide substrate. A number of such cartridges may be loaded into an HPHT press. The substrates and volume of diamond particles are then processed under HPHT conditions in the presence of a catalyst that causes the diamond particles to bond to one another to form a matrix of bonded diamond grains defining a polycrystalline diamond ("PCD") table that is bonded to the substrate. The catalyst is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of bonded diamond grains.

The presence of the metal-solvent catalyst in the PCD table is believed to reduce the thermal stability of the PCD table at elevated temperatures. For example, the difference in thermal expansion coefficient between the diamond grains and the metal-solvent catalyst is believed to lead to chipping or cracking of the PCD table during drilling or cutting operations, which can degrade the mechanical properties of the PCD table or cause failure. Additionally, some of the diamond grains can undergo a chemical breakdown or back-conversion to graphite via interaction with the solvent catalyst. At elevated high temperatures, portions of diamond grains may transform to carbon monoxide, carbon dioxide, graphite, or combinations thereof, thereby degrading the mechanical properties of the PDC.

One conventional approach for improving the thermal stability of a PDC is to at least partially remove the solvent catalyst from the PCD table of the PDC by acid leaching. However, removing the metal-solvent catalyst from the PCD table can be relatively time consuming for high-volume manufacturing. Additionally, depleting the metal-solvent catalyst may decrease the mechanical strength of the PCD table. Another approach for increasing the durability of PDC is to polish the substantially planar cutting face of the PCD table of the PDC. [CW1] Despite the availability of a number of different PCD materials, manufacturers and users of PCD materials continue to seek PCD materials that exhibit improved performance, mechanical and/or thermal properties.

SUMMARY

The instant disclosure is directed to superabrasive elements and methods of manufacturing superabrasive elements. According to at least one embodiment, a superabrasive element may comprise a substrate, and a superabrasive table bonded to the substrate. The superabrasive table may comprise a polished surface having a polished finish, the polished surface extending over at least a central, apical region of the superabrasive table, and an unpolished surface having an unpolished finish, the unpolished surface substantially surrounding or surrounding a majority of the polished surface.

According to at least one embodiment, at least a portion of the unpolished surface of the superabrasive table may be substantially conical. In various embodiments, at least a portion of the unpolished surface of the superabrasive table may be non-planar. At least a portion of the unpolished surface of the superabrasive table may be substantially arcuate and concave. According to certain embodiments, at least a portion of the unpolished surface of the superabrasive table may be substantially arcuate and convex.

According to various embodiments, the central, apical region of the superabrasive table may be domed. The central, apical region of the superabrasive table may be at least partially leached.

In various embodiments, a superabrasive element may comprise a substrate and a superabrasive table bonded to the substrate. The superabrasive table may comprise a polished surface having a polished finish, the polished surface extending over at least a central, arcuate, apical region of the superabrasive table, and an unpolished surface having an unpolished finish, the unpolished surface substantially surrounding or surrounding a majority of the polished surface. According to at least one embodiment, at least a portion of the unpolished surface may be substantially conical.

According to certain embodiments, a method of manufacturing a superabrasive element may comprise providing a superabrasive element comprising a substrate and a superabrasive table bonded to the substrate. The method of manufacturing a superabrasive element may further comprise polishing at least a central, apical region of the superabrasive table to form a polished surface, without polishing an unpolished surface of the superabrasive table.

According to at least one embodiment, the unpolished surface may substantially surround or surround a majority of the polished surface.

According to various embodiments, at least a portion of the polished surface of the superabrasive table may be substantially arcuate. At least a portion of the unpolished surface of the superabrasive table may be substantially conical. According to various embodiments, at least a portion of the unpolished surface of the superabrasive table may be non-planar. At least a portion of the unpolished surface of the superabrasive table may be substantially arcuate and concave. In certain embodiments, at least a portion of the unpolished surface of the superabrasive table may be substantially arcuate and convex.

According to at least one embodiment, polishing at least the central, apical region may comprise grinding, lapping, chemical polishing, laser polishing, ion beam polishing, or combinations thereof. Polishing at least the central, apical region may comprise grinding or lapping without coolant.

According to certain embodiments, the method of manufacturing a superabrasive element may further comprise leaching at least the central, apical region. Providing the superabrasive element may comprise providing the superabrasive table with a domed, central, apical region. Providing the superabrasive element may comprise providing the superabrasive table with a conical surface surrounding the domed, central, apical region.

According to at least one embodiment, a superabrasive element may comprise a substrate and a superabrasive table bonded to the substrate. The superabrasive table may comprise a first surface having a polished finish, the polished surface extending over at least a central, apical region of the superabrasive table, and a second surface having a greater surface roughness than the first surface. The second surface may substantially surround or surround a majority of the first surface.

Further embodiments relate to applications utilizing the disclosed PCD elements and PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

The instant disclosure is directed to attack inserts with differing surface finishes, assemblies, systems including the same, and related methods. For example, embodiments of an attack insert (e.g. a superabrasive element or a PDC) may include a superabrasive body bonded to a substrate. Such superabrasive elements may be used as cutting elements for use in a variety of applications, such as drilling tools, machining equipment, cutting tools, and other apparatuses, without limitation. Superabrasive elements, as disclosed herein, may also be used as bearing elements in a variety of bearing applications, such as thrust bearings, radial bearings, and other bearing apparatuses, without limitation. Superabrasive elements disclosed herein may also be used in machining equipment, molding equipment, wire dies, bearings, artificial joints, inserts, heat sinks, and other articles and apparatuses, or in any combination of the foregoing.

As used herein, the terms "superabrasive" or "superhard" refer to materials exhibiting a hardness that is at least equal to a hardness of tungsten carbide. For example, a superabrasive article may represent an article of manufacture, at least a portion of which may exhibit a hardness that is equal to or greater than the hardness of tungsten carbide. Moreover, the word "cutting" refers broadly to machining processes, drilling processes, boring processes, or any other material removal process utilizing a cutting element.

In some embodiments, a superabrasive element may be utilized as a cutting element for a drill bit, in which a portion of a superabrasive table acts as a working surface. The phrase "working surface" may refer, without limitation, to a portion of a cutting element that is configured to be exposed to and/or in contact with a subterranean formation during drilling.

Figure 2:
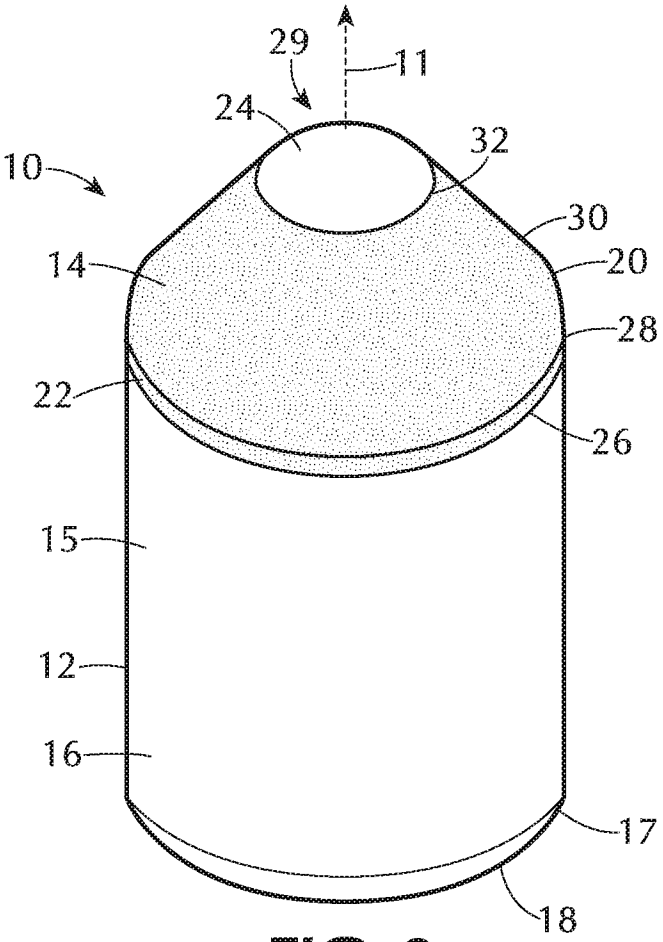
FIG. 2 is a perspective view of a superabrasive element according to an embodiment.
Figure 1:
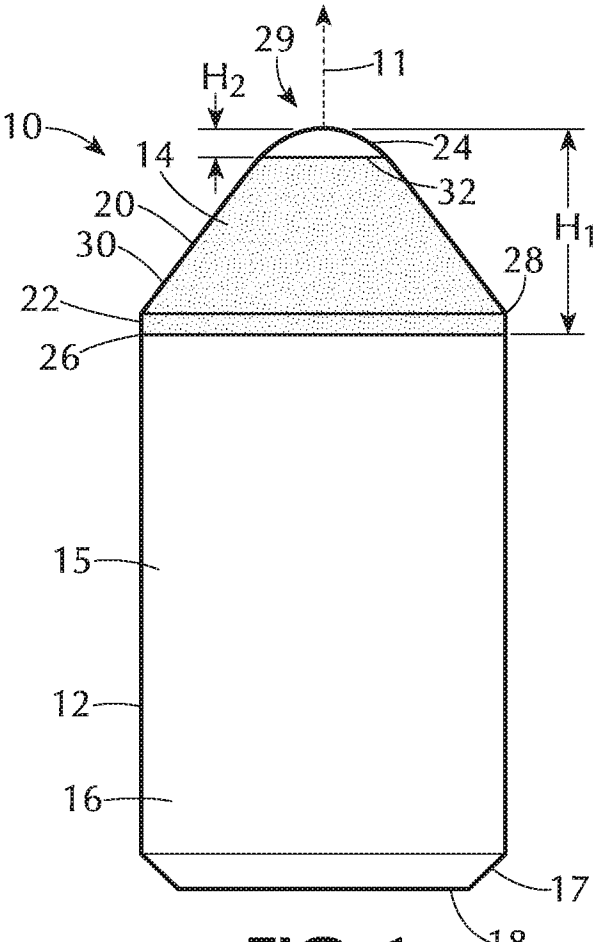
FIG. 1 is a side view of a superabrasive element according to an embodiment.

FIGS. 1 and 2 illustrate superabrasive elements 10 according to various embodiments. As illustrated in FIGS. 1 and 2, superabrasive element 10 may comprise a superabrasive table 14 affixed to or formed upon a substrate 12. Superabrasive table 14 may be affixed to substrate 12 at an interface 26, which may be substantially planar or non-planar (e.g., three-dimensionally domed, dimpled, hemispherical, conical, frustoconical, pyramidal, spherical, cubic, polyhedral, combinations thereof, or any other non-planar, three-dimensional shape; or cross-sectionally zigzagged, stepped, arcuate, undulating, sinusoidal, combinations thereof, and/or any other non-planar cross-sectional configuration). Superabrasive element 10 may comprise a rear surface 18, a superabrasive surface 20, and an element side surface 15. In some embodiments, element side surface 15 may include a substrate side surface 16 formed by substrate 12 and a superabrasive side surface 22 formed by superabrasive table 14. Rear surface 18 may be formed by substrate 12.

Any suitable surface shape may also be formed at the intersection of superabrasive side surface 22 and superabrasive surface 20, including, without limitation, an arcuate surface (e.g., a radius, an ovoid shape, or any other rounded shape), a sharp edge, multiple chamfers/radii, a honed edge, and/or combinations of the foregoing. At least one edge may be formed at the intersection of superabrasive surface 20 and superabrasive side surface 22. For example, cutting element 10 may comprise one or more edges, such as an edge 28. Edge 28 may be formed adjacent to superabrasive surface 20 and superabrasive side surface 22.

Superabrasive element 10 may comprise any suitable size, shape, and/or geometry, without limitation. According to at least one embodiment, at least a portion of superabrasive element 10 may have a substantially cylindrical shape. For example, superabrasive element 10 may comprise a substantially cylindrical outer surface surrounding a central axis 11 of superabrasive element 10, as illustrated in FIGS. 1 and 2. Substrate side surface 16 and superabrasive side surface 22 may, for example, be substantially cylindrical and may have any suitable diameter(s) relative to central axis 11, without limitation. According to various embodiments, substrate side surface 16 and superabrasive side surface 22 may have substantially the same outer diameter relative to central axis 11. Superabrasive element 10 may also comprise any other suitable shape (e.g., in cross-section or otherwise), including, for example, an oval, ellipsoid, triangular, square, rectangular, polygonal, and/or composite shape, and/or a combination of the foregoing, without limitation. According to at least one embodiment, at least a portion of superabrasive element 10 may have a substantially conical shape. For example, superabrasive surface 20 of superabrasive table 14 may comprise a substantially conical outer surface surrounding central axis 11 of superabrasive element 10, as illustrated in FIGS. 1 and 2.

According to various embodiments, superabrasive element 10 may also comprise a substrate chamfer 17 formed by substrate 12. For example, a substrate chamfer 17 comprising an angular and/or rounded edge may be formed by substrate 12 at the intersection of substrate side surface 16 and rear surface 18. Any other suitable surface shape may also be formed at the intersection of substrate side surface 16 and rear surface 18, including, without limitation, an arcuate surface (e.g., a radius, an ovoid shape, or any other rounded shape), a sharp edge, multiple chamfers/radii, a honed edge, and/or combinations of the foregoing.

Substrate 12 may comprise any suitable material on which superabrasive table 14 may be formed. In at least one embodiment, substrate 12 may comprise a cemented carbide material, such as a cobalt-cemented tungsten carbide material and/or any other suitable material. In some embodiments, substrate 12 may include a suitable metal-solvent catalyst material, such as, for example, cobalt, nickel, iron, and/or alloys thereof. Substrate 12 may include any suitable material including, without limitation, cemented carbides such as titanium carbide, niobium carbide, tantalum carbide, vanadium carbide, chromium carbide, and/or combinations of any of the preceding carbides cemented with iron, nickel, cobalt, and/or alloys thereof. Superabrasive table 14 may be formed of any suitable superabrasive and/or superhard material or combination of materials, including, for example PCD. According to additional embodiments, superabrasive table 14 may comprise cubic boron nitride, silicon carbide, polycrystalline diamond, and/or mixtures or composites including one or more of the foregoing materials, without limitation.

Superabrasive table 14 may be formed using any suitable technique. According to some embodiments, superabrasive table 14 may comprise a PCD table fabricated by subjecting a plurality of diamond particles to an HPHT sintering process in the presence of a metal-solvent catalyst (e.g., cobalt, nickel, iron, or alloys thereof) to facilitate intergrowth between the diamond particles and form a PCD body comprised of bonded diamond grains that exhibit diamond-to-diamond bonding therebetween. For example, the metal-solvent catalyst may be mixed with the diamond particles, infiltrated from a metal-solvent catalyst foil or powder adjacent to the diamond particles, infiltrated from a metal-solvent catalyst present in a cemented carbide substrate, or combinations of the foregoing. The bonded diamond grains (e.g., $sp^3$-bonded diamond grains), so-formed by HPHT sintering the diamond particles, define interstitial regions with the metal-solvent catalyst disposed within the interstitial regions of the as-sintered PCD body. The diamond particles may exhibit a selected diamond particle size distribution. Polycrystalline diamond elements, such as those disclosed in U.S. Pat. Nos. 7,866,418 and 8,297,382, the disclosure of each of which is incorporated herein, in its entirety, by this reference, may have properties (e.g. magnetic properties) in at least some regions.

Following sintering, various materials, such as a metal-solvent catalyst, remaining in interstitial regions within the as-sintered PCD body may reduce the thermal stability of superabrasive table 14 at elevated temperatures. In some examples, differences in thermal expansion coefficients between diamond grains in the as-sintered PCD body and a metal-solvent catalyst in interstitial regions between the diamond grains may weaken portions of superabrasive table 14 that are exposed to elevated temperatures, such as temperatures developed during drilling and/or cutting operations. The weakened portions of superabrasive table 14 may be excessively worn and/or damaged during the drilling and/or cutting operations.

At least partially removing the metal-solvent catalyst and/or other materials from the as-sintered PCD body may improve the heat resistance and/or thermal stability of superabrasive table 14, particularly in situations where the PCD material may be exposed to elevated temperatures. A metal-solvent catalyst and/or other materials may be at least partially removed from the as-sintered PCD body using any suitable technique, including, for example, leaching. In at least one embodiment, a metal-solvent catalyst, such as cobalt, may be removed from regions of the as-sintered PCD body, such as regions adjacent to the working surfaces of superabrasive table 14. Removing a metal-solvent catalyst from the as-sintered PCD body may reduce damage to the PCD material of superabrasive table 14 caused by expansion of the metal-solvent catalyst.

At least a portion of a metal-solvent catalyst, such as cobalt, as well as other materials, may be removed from at least a portion of the as-sintered PCD body using any suitable technique, without limitation. For example, electrochemical, chemical, and/or gaseous leaching may be used to remove a metal-solvent catalyst from the as-sintered PCD body up to a desired depth from a surface thereof. The as-sintered PCD body may be leached by immersion in an acid or acid solution, such as aqua regia, nitric acid, hydrofluoric acid, or subjected to another suitable process to remove at least a portion of the metal-solvent catalyst from the interstitial regions of the PCD body and form superabrasive table 14 comprising a PCD table. For example, the as-sintered PCD body may be immersed in an acid solution for more than 4 hours, more than 10 hours, between about 24 hours and about 48 hours, about 2 to about 7 days (e.g., about 3, 5, or 7 days), for a few weeks (e.g., about 4 weeks), or for 1-2 months, depending on the process employed.

Even after leaching, a residual, detectable amount of the metal-solvent catalyst may be present in the at least partially leached superabrasive table 14. It is noted that when the metal-solvent catalyst is infiltrated into the diamond particles from a cemented tungsten carbide substrate including tungsten carbide particles cemented with a metal-solvent catalyst (e.g., cobalt, nickel, iron, or alloys thereof), the infiltrated metal-solvent catalyst may carry tungsten and/or tungsten carbide therewith and the as-sintered PCD body may include such tungsten and/or tungsten carbide therein disposed interstitially between the bonded diamond grains. The tungsten and/or tungsten carbide may be at least partially removed by the selected leaching process or may be relatively unaffected by the selected leaching process.

In some embodiments, only selected portions of the as-sintered PCD body may be leached, leaving remaining portions of resulting superabrasive table 14 unleached. For example, some portions of one or more surfaces of the as-sintered PCD body may be masked or otherwise protected from exposure to a leaching solution and/or gas mixture while other portions of one or more surfaces of the as-sintered PCD body may be exposed to the leaching solution and/or gas mixture. Other suitable techniques may be used for removing a metal-solvent catalyst and/or other materials from the as-sintered PCD body or may be used to accelerate a chemical leaching process. For example, exposing the as-sintered PCD body to heat, pressure, electric current, microwave radiation, and/or ultrasound may be employed to leach or to accelerate a chemical leaching process, without limitation. Following leaching, superabrasive table 14 may comprise a volume of PCD material that is at least partially free or substantially free of a metal-solvent catalyst.

The plurality of diamond particles used to form superabrasive table 14 comprising the PCD material may exhibit one or more selected sizes. The one or more selected sizes may be determined, for example, by passing the diamond particles through one or more sizing sieves or by any other suitable method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 15 μm, 12 μm, 10 μm, 8 μm, 4 μm, 2 μm, 1 μm, 0.5 μm, less than 0.5 μm, 0.1 μm, less than 0.1 μm). In another embodiment, the plurality of diamond particles may include a portion exhibiting a relatively larger size between about 40 μm and about 15 μm and another portion exhibiting a relatively smaller size between about 12 μm and 2 μm. Of course, the plurality of diamond particles may also include three or more different sizes (e.g., one relatively larger size and two or more relatively smaller sizes) without limitation. Different sizes of diamond particle may be disposed in different locations within a polycrystalline diamond volume, without limitation.

According to various embodiments, at least a portion of the surface of superabrasive table 14, such as a central, apical region, may be polished. For example, as shown in FIGS. 1 and 2, a polished surface 24 of superabrasive table 14 may be polished. Superabrasive table 14 may include an apex 29 defined at an axially forward position of superabrasive table 14. Apex 29 of superabrasive table 14 may be defined at a position adjacent to central axis 11 of superabrasive element 10. As shown in FIGS. 1 and 2, polished surface 24 of superabrasive table 14 may extend axially rearward from apex 29 of superabrasive 14 along at least a portion of superabrasive surface 20 of superabrasive table 14. Polished surface 24 may be substantially centered about central axis 11 of superabrasive element 10. FIGS. 1 and 2 illustrate an embodiment in which polished surface 24 may be substantially disposed on an axially forward, apical portion of superabrasive table 14. According to at least one embodiment, polished surface 24 may comprise a working surface of superabrasive table 14. According to various embodiments, polished surface 24 may be substantially planar or non-planar (e.g., three-dimensionally domed, dimpled, hemispherical, conical, frustoconical, pyramidal, spherical, cubic, polyhedral, combinations thereof, or any other non-planar, three-dimensional shape; or cross-sectionally zig-zagged, stepped, arcuate, undulating, sinusoidal, combinations thereof, or any other non-planar cross-sectional configuration). For example, polished surface 24 of superabrasive surface 20 may be non-planar and arcuate. As shown in FIGS. 1 and 2, polished surface 24 may be substantially domed.

In some embodiments, only selected portions of the surface of superabrasive table 14 may be polished. For example, some portions of superabrasive table 14 circumferentially surrounding polished surface 24 may not be polished and/or may have a greater surface roughness than polished surface 24. According to at least one embodiment, an unpolished surface 30 substantially surrounding polished surface 24 may not be polished. According to various embodiments, unpolished surface 30 may surround most of or a majority of polished surface 24. Unpolished surface 30 may be substantially planar or non-planar (e.g., three-dimensionally domed, dimpled, hemispherical, conical, frustoconical, pyramidal, spherical, cubic, polyhedral, combinations thereof, or any other non-planar, three-dimensional shape; or cross-sectionally zig-zagged, stepped, arcuate, undulating, sinusoidal, combinations thereof, or any other non-planar cross-sectional configuration). As illustrated in FIGS. 1 and 2, unpolished surface 30 may be substantially conical. In some embodiments, unpolished surface 30 may comprise a portion of superabrasive table 14 that is not a working surface. Unpolished surface 30 may be configured to be exposed to and/or in contact with a subterranean formation to a lesser extent than polished surface 24 during drilling.

According to various embodiments, polished surface 24 may be adjacent to unpolished surface 30 at a polished interface 32. Polished interface 32 may extend along any suitable profile, without limitation. For example, polished interface 32 may be substantially linear or substantially non-linear. Although illustrated in FIGS. 1 and 2 as a line, polished interface 32 may be a transition surface region in which the surface finish transitions between polished surface 24 and unpolished surface 30. The transition surface region may have a surface roughness in-between the surface roughness of polished surface 24 and unpolished surface 30. In various embodiments, the transition surface region may comprise a relatively narrow region between polished surface 24 and unpolished surface 30.

A variety of polishing methods may be employed to polish polished surface 24. For example, polished surface 24 may be polished by grinding, lapping, chemical polishing, laser polishing, ion beam polishing, or combinations thereof, or any other polishing method. Methods and apparatuses for polishing cutting faces of PDCs may be found, for example, in U.S. Pat. Nos. 5,447,208; 5,653,300; 5,967,250; and 6,145,608, the disclosure of each of which is incorporated herein, in its entirety, by this reference. According to at least one embodiment, polishing polished surface 24 may comprise grinding or lapping without the use of coolant.

In an example of a cutting element according to the prior art, a working surface or superabrasive surface of the cutting element may be lapped to an unpolished surface roughness ranging from about 20 μin to about 40 μin Root Mean Square ("RMS") (all surface finishes referenced herein being RMS). In one example according to the Present Application, polished surface 24 may be polished to a surface roughness of about 20 μin or less. More specifically, in some embodiments, the surface roughness of polished surface 24 may be about 10 μin or less, about 2 μin or less, or about 0.5 μin or less. According to various embodiments, unpolished surface 30 may have a surface roughness ranging from about 20 μin to about 40 μin.

In some embodiments, polished surface 24 may be disposed on less than about 95% of the surface area of superabrasive table 14. For example, polished surface 24 may be disposed on about 4% to about 55%, about 10% to about 50%, about 10% to about 30%, about 10% to about 20%, about 15% to about 25%, or about 20% to about 40% of the surface area of superabrasive table 14. According to at least one embodiment, as shown in FIGS. 1 and 2, polished surface 24 may be disposed on about 12% of the surface area of superabrasive table 14.

The distance from interface 26 to apex 29 of superabrasive table 14 may be defined by a superabrasive table height $H_1$. The distance from polished interface 32 to apex 29 of superabrasive table 14 may be defined by a polished height $H_2$. Polished height $H_2$ may be less than about 95% of superabrasive table height $H_1$. In various embodiments, polished height $H_2$ may range from about 6% to about 60% of superabrasive table height $H_1$. More specifically, in some embodiments, polished height $H_2$ may range from about 10% to about 50%, about 10% to about 20%, about 20% to about 30%, about 30% to about 40%, or about 12% to about 40% of superabrasive table height $H_1$. According to at least one embodiment, as shown in FIGS. 1 and 2, polished height $H_2$ may be about 20% of superabrasive table height $H_1$.

Polishing polished surface 24 of superabrasive table 14 may decrease the friction between the working surface and a subterranean formation during drilling. According to various embodiments, polished surface 24 may decrease the amount of heat generated and/or decrease the frictional losses during the drilling operation. Polished surface 24 may reduce the quantity of cracks formed in superabrasive table 14 during drilling, thereby reducing damage to the PCD material of superabrasive table 14 caused by cracking and overheating. Furthermore, polished surface 24 may decrease the tangential and normal forces required to drill through a subterranean formation.

Superabrasive table 14 may have any suitable thickness. For example, the thickness of superabrasive table 14 may range from about 0.005 inches to about 0.400 inches. In various embodiments, the thickness of superabrasive table 14 may range from about 0.020 inches to about 0.400 inches, about 0.030 to about 0.350 inches, about 0.050 to about 0.300 inches, 0.030 inches to about 0.320 inches, or about 0.060 to about 0.250 inches. The thickness of superabrasive table 14 may be less than about 0.500 inches, less than about 0.450 inches, less than about 0.400 inches, less than about 0.300 inches, less than about 0.250 inches, less than about 0.200 inches, less than about 0.150 inches, or less than about 0.100 inches. According to at least one embodiment, the thickness of superabrasive table may be greater than about 0.005 inches, greater than about 0.010 inches, greater than about 0.020 inches, greater than about 0.050 inches, greater than about 0.100 inches, or greater than about 0.150 inches. The thickness of superabrasive table 14 may vary at positions located radially outward from central axis 11. For example, according to at least one embodiment, the thickness of superabrasive table 14 may be greatest at a position located at central axis 11. According to other embodiments, the thickness of superabrasive table 14 may be greatest at a position located adjacent to superabrasive side surface 22. According to still further embodiments, the thickness of superabrasive table 14 may be substantially constant at positions located radially outward from central axis 11.

FIGS. 3-8 illustrate superabrasive elements 10 according to various embodiments. Superabrasive element 10 may comprise a superabrasive table 14 affixed to a substrate 12 along an interface 26. Interface 26 may extend along any suitable profile, without limitation. For example, interface 26 may be substantially planar or non-planar (e.g., three-dimensionally domed, dimpled, hemispherical, conical, frustoconical, pyramidal, spherical, cubic, polyhedral, combinations thereof, or any other non-planar, three-dimensional shape; or cross-sectionally zig-zagged, stepped, arcuate, undulating, sinusoidal, combinations thereof, or any other non-planar cross-sectional configuration).

Figure 3:
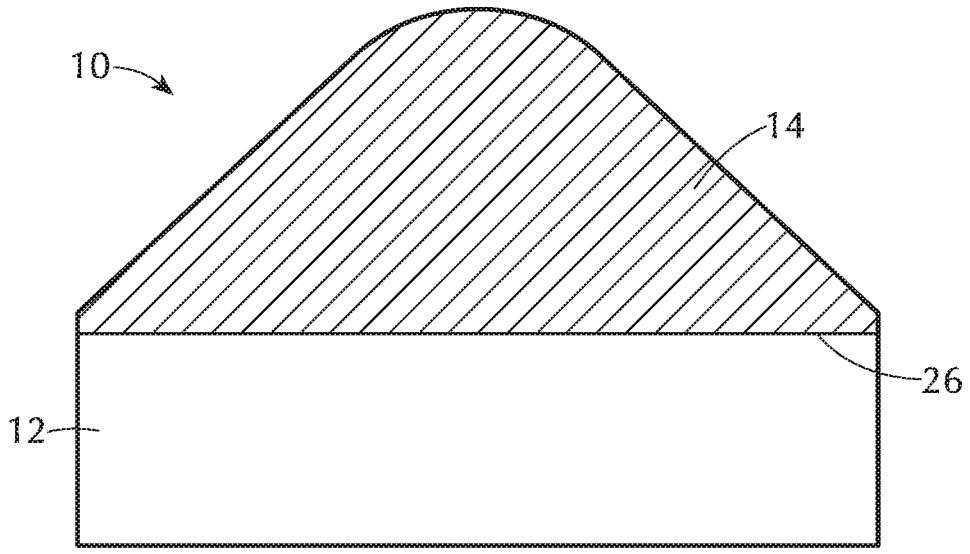
FIG. 3 is a cross-sectional side view of a superabrasive element according to an embodiment.

According to at least one embodiment, interface 26 may be substantially planar. For example, as illustrated in FIG. 3, interface 26 may be substantially planar.

Figure 4:
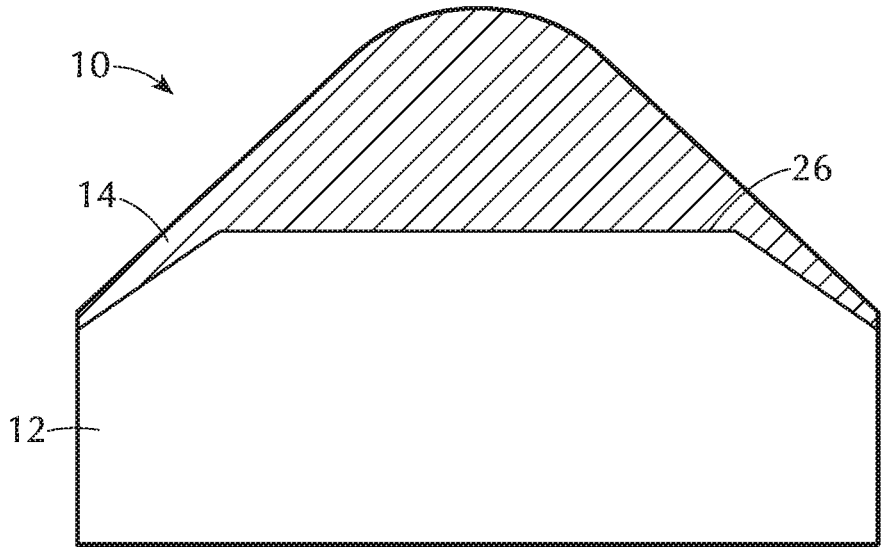
FIG. 4 is a cross-sectional side view of a superabrasive element according to an embodiment.

In some embodiments, as illustrated in FIG. 4, interface 26 may have a substantially planar portion and a non-planar portion. For example, interface 26 may have a substantially planar central portion surrounded by a tapered portion (e.g., a substantially conical portion).

Figure 5:
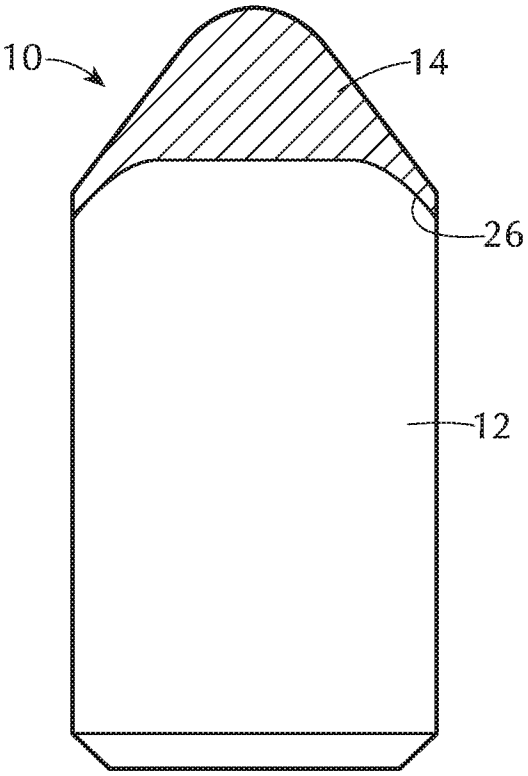
FIG. 5 is a cross-sectional side view of a superabrasive element according to an embodiment.

As illustrated in FIG. 5, interface 26 may be non-planar. For example, interface 26 may comprise a substantially dimpled profile comprising two or more curved regions.

Figure 6:
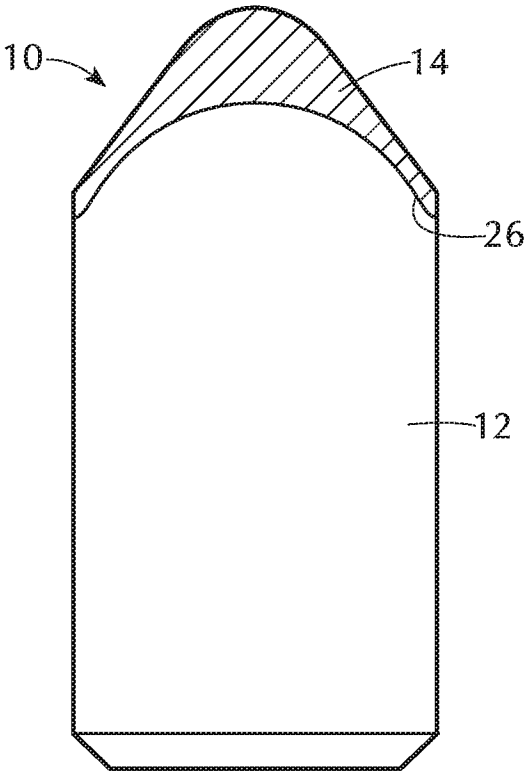
FIG. 6 is a cross-sectional side view of a superabrasive element according to an embodiment.

In some embodiments, interface 26 may be non-planar. For example, interface 26 may comprise a substantially arcuate profile comprising a convex interface surface, as illustrated in FIG. 6.

Figure 7:
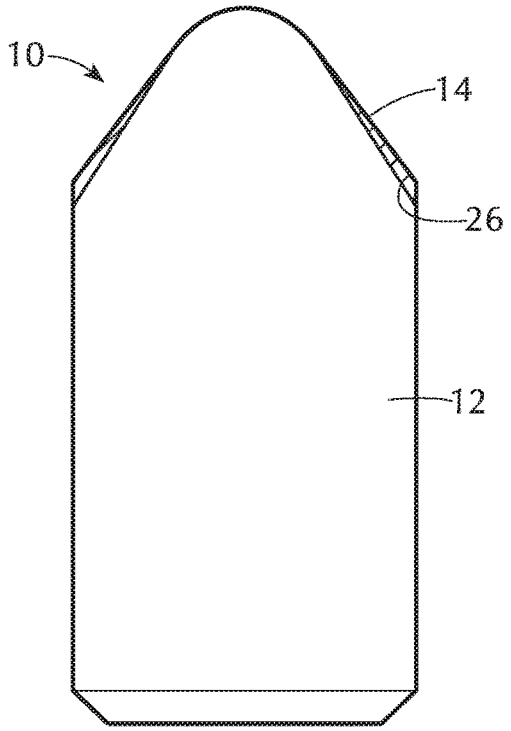
FIG. 7 is a cross-sectional side view of a superabrasive element according to an embodiment.

Interface 26 may have substantially planar portions and non-planar portions. For example, interface 26 may have a domed or partially substantially spherical central portion surrounded by a substantially conical portion, as illustrated in FIG. 7.

Figure 8:
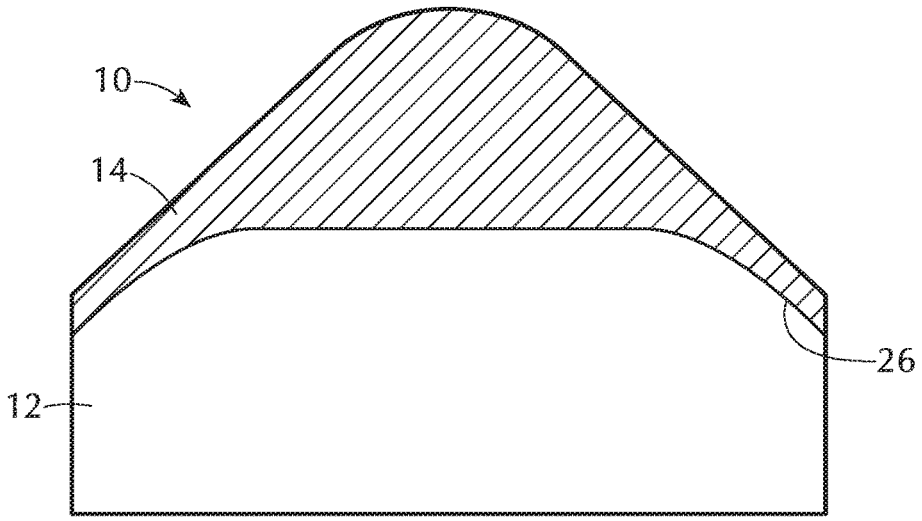
FIG. 8 is a cross-sectional side view of a superabrasive element according to an embodiment.

Interface 26 may have one or more substantially planar portions and one or more non-planar portions. For example, interface 26 may have a substantially planar central portion surrounded by a substantially arcuate portion, as illustrated in FIG. 8.

FIGS. 9-12 illustrate superabrasive elements 10 according to various embodiments. Superabrasive element 10 may comprise a superabrasive table 14 affixed to a substrate 12 at an interface 26. Superabrasive table 14 may be polished to yield various configurations of a polished surface 24, an unpolished surface 30, and a polished interface 32. Polished interface 32 may extend along any suitable profile, without limitation. For example, polished interface 32 may be substantially linear or non-linear. In some embodiments, polished interface 32 may vary along an arcuate or undulating path.

The distance from interface 26 to apex 29 of superabrasive table 14 may be defined by a superabrasive table height $H_1$. At a certain circumferential position, the distance from polished interface 32 to apex 29 of superabrasive table 14 may be defined by a polished height $H_2$. Polished height $H_2$ may vary along the path of polished interface 32 (e.g., an arcuate or undulating path). An average polished height may be determined, for example, by adding a minimum polished height, determined at a circumferential position at which the distance from the polished interface 32 to apex 29 of superabrasive table 14 is at a minimum, to a maximum polished height, determined at a circumferential position at which the distance from the polished interface 32 to apex 29 of superabrasive table 14 is at a maximum, and dividing the sum of the minimum polished height and the maximum polished height by two. In some embodiments, an average polished height may be determined by averaging polished heights measured at more than two circumferential positions. The average polished height may be less than about 95% of superabrasive table height $H_1$. In various examples, the average polished height may range from about 6% to about 60% of superabrasive table height $H_1$. More specifically, in some embodiments, the average polished height may range from about 10% to about 50% or about 12% to about 40% of superabrasive table height $H_1$. According to at least one embodiment, as shown in FIGS. 1 and 2, the average polished height may be about 20% of superabrasive table height $H_1$.

Figure 9:
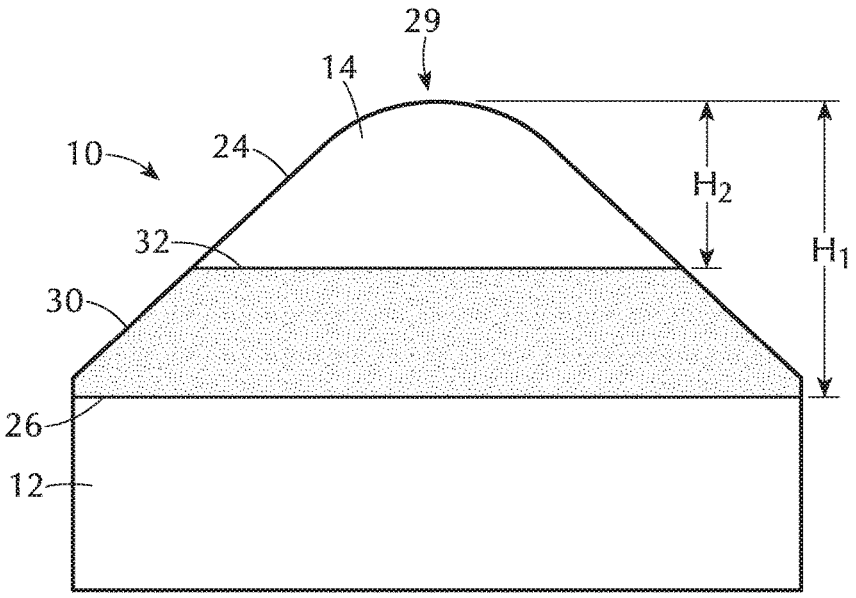
FIG. 9 is a side view of a superabrasive element according to an embodiment.

According to at least one embodiment, polished height $H_2$ may be substantially constant along the circumference of superabrasive table 14. For example, as shown in FIG. 9, a position of polished interface 32 may be substantially constant. In one embodiment, an average polished height $H_2$ of polished surface 24 may be about 60% of superabrasive table height $H_1$. According to at least one embodiment, polished surface 24 may be disposed on about or at least about 55% of the surface area of superabrasive table 14. In other embodiments, polished surface 24 may be disposed on at least about 40%, at least about 45%, or at least about 50% of the surface area of superabrasive table 14.

Figure 10:
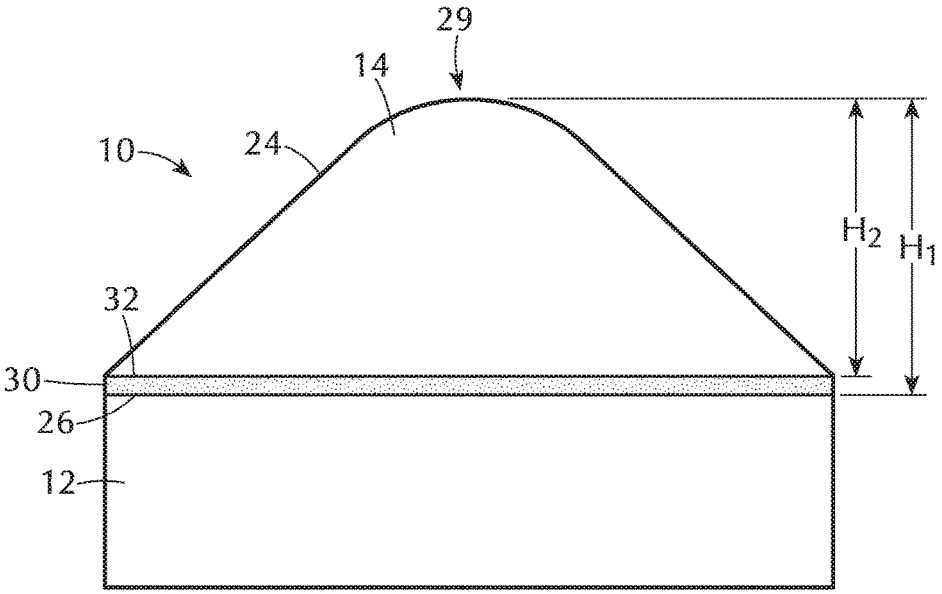
FIG. 10 is a side view of a superabrasive element according to an embodiment.

As illustrated in FIG. 10, polished interface 32 may be substantially constant. Polished height $H_2$ of polished surface 24 may be at least about 70%, at least about 80%, at least about 90%, or at least about 95% of superabrasive table height $H_1$. According to at least one embodiment, polished surface 24 may be disposed on less than 40%, less than 50%, less than 60%, or less than 70% of the surface area of superabrasive table 14.

Figure 11:
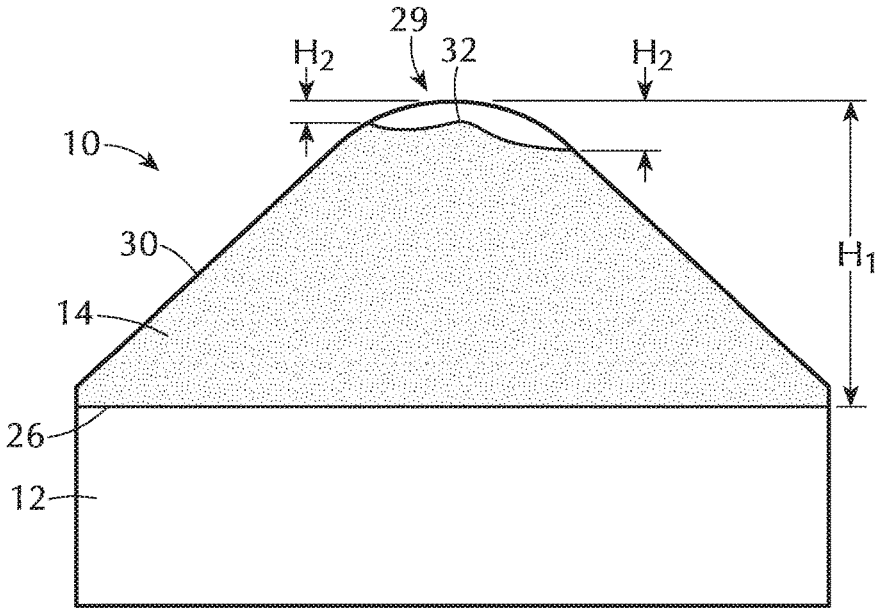
FIG. 11 is a side view of a superabrasive element according to an embodiment.

According to various embodiments, a position or height of polished interface 32 may vary. For example, as shown in FIG. 11, a height of polished interface 32 may vary. According to at least one embodiment, polished surface height $H_2$ may vary around the circumference of superabrasive element 10. For example, polished surface height $H_2$ may be greater on one side (or a certain circumferential position) of superabrasive element 10 than another side (or another circumferential position) of superabrasive element 10.

Figure 12:
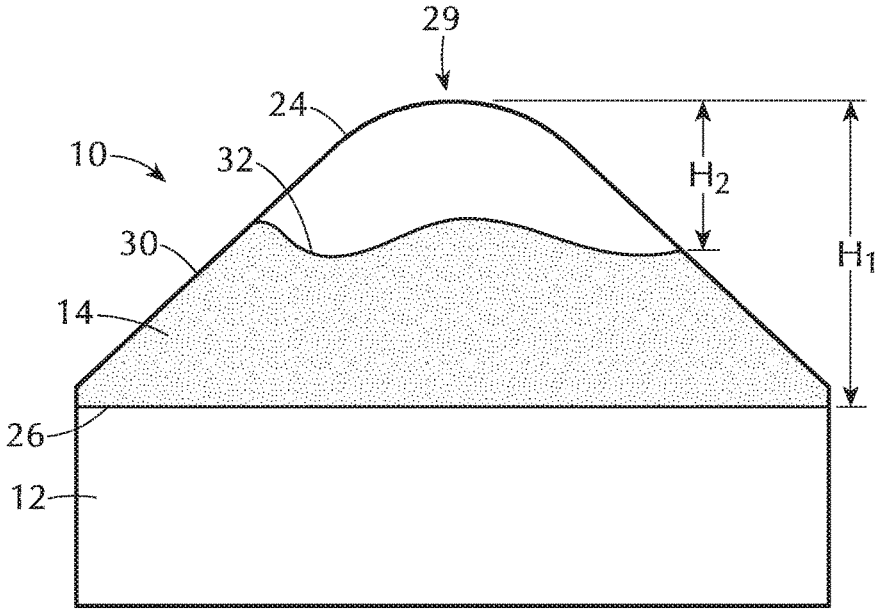
FIG. 12 is a side view of a superabrasive element according to an embodiment.

According to various embodiments, a position or height of polished interface 32 may vary. For example, as shown in FIG. 12, a position or height of polished interface 32 may undulate. According to at least one embodiment, polished surface height $H_2$ may vary around the circumference of superabrasive element 10. For example, polished surface height $H_2$ may vary along a wavy or undulating path around the surface of superabrasive element 10. An average value of polished height $H_2$ of polished surface 24 may be at least about 20%, at least about 30%, at least about 40%, at least about 50%, or at least about 60% of superabrasive table height $H_1$. According to at least one embodiment, polished surface 24 may be disposed on about 10%, about 11%, about 12%, about 13%, about 14%, or about 15% of the surface area of superabrasive table 14.

FIGS. 13-16 illustrate superabrasive elements 10 according to various embodiments. Superabrasive element 10 may comprise a superabrasive table 14 affixed to a substrate 12 at an interface 26. Superabrasive table 14 may comprise a superabrasive surface 20 and a superabrasive side surface 22. Superabrasive table 14 may be polished to yield various configurations of a polished surface 24, an unpolished surface 30, and a polished interface 32. Superabrasive table 14 may have various configurations. For example, superabrasive table 14 may have a substantially cylindrical superabrasive side surface 22. Superabrasive surface 20 of superabrasive table 14 may be substantially planar or non-planar (e.g., three-dimensionally domed, dimpled, hemispherical, conical, frustoconical, pyramidal, spherical, cubic, polyhedral, combinations thereof, or any other non-planar, three-dimensional shape; or cross-sectionally zigzagged, stepped, arcuate, undulating, sinusoidal, combinations thereof, or any other non-planar cross-sectional configuration).

Figure 13:
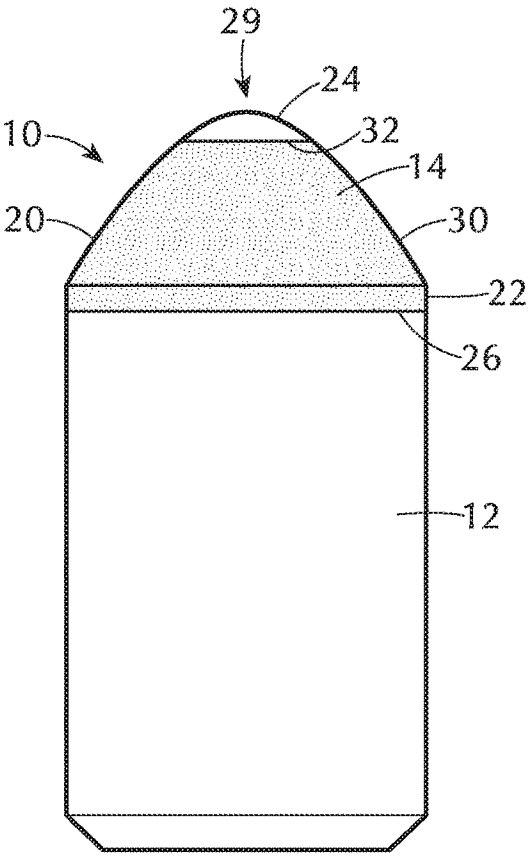
FIG. 13 is a side view of a superabrasive element according to an embodiment.

According to at least one embodiment, as illustrated in FIG. 13, superabrasive surface 20 of superabrasive table 14 may be non-planar. For example, polished surface 24 of superabrasive surface 20 may be non-planar and arcuate (e.g., generally convex). As shown in FIG. 13, polished surface 24 may be substantially domed. Unpolished surface 30 of superabrasive surface 20 may be non-planar and arcuate. As illustrated in FIG. 13, unpolished surface 30 may be substantially convex and tapered.

Figure 14:
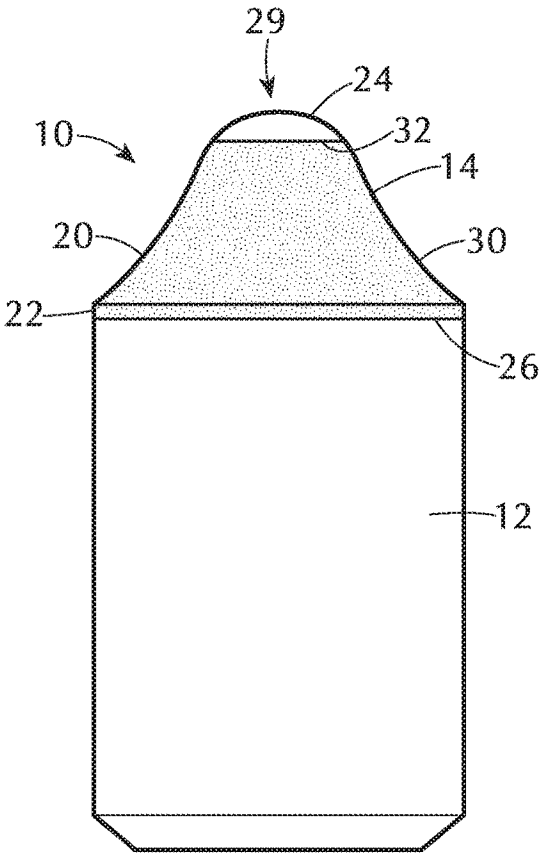
FIG. 14 is a side view of a superabrasive element according to an embodiment.

According to various embodiments, as illustrated in FIG. 14, superabrasive surface 20 of superabrasive table 14 may be non-planar. For example, polished surface 24 of superabrasive surface 20 may be non-planar and arcuate (e.g., generally convex). As shown in FIG. 14, polished surface 24 may be substantially domed. Unpolished surface 30 of superabrasive surface 20 may be non-planar and arcuate. As illustrated in FIG. 14, unpolished surface 30 may be substantially concave, and tapered.

Figure 15:
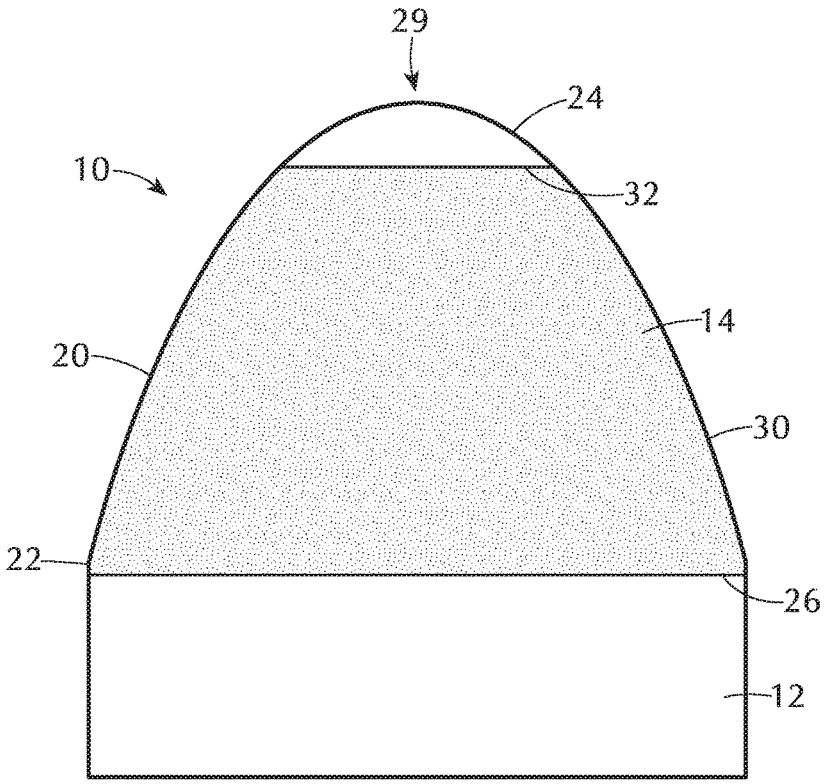
FIG. 15 is a side view of a superabrasive element according to an embodiment.

According to at least one embodiment, as illustrated in FIG. 15, superabrasive surface 20 of superabrasive table 14 may be non-planar. For example, polished surface 24 of superabrasive surface 20 may be non-planar and arcuate. As shown in FIG. 15, polished surface 24 may be substantially domed. Unpolished surface 30 of superabrasive surface 20 may be non-planar and convex. As illustrated in FIG. 15, unpolished surface 30 may be substantially paraboloid.

Figure 16:
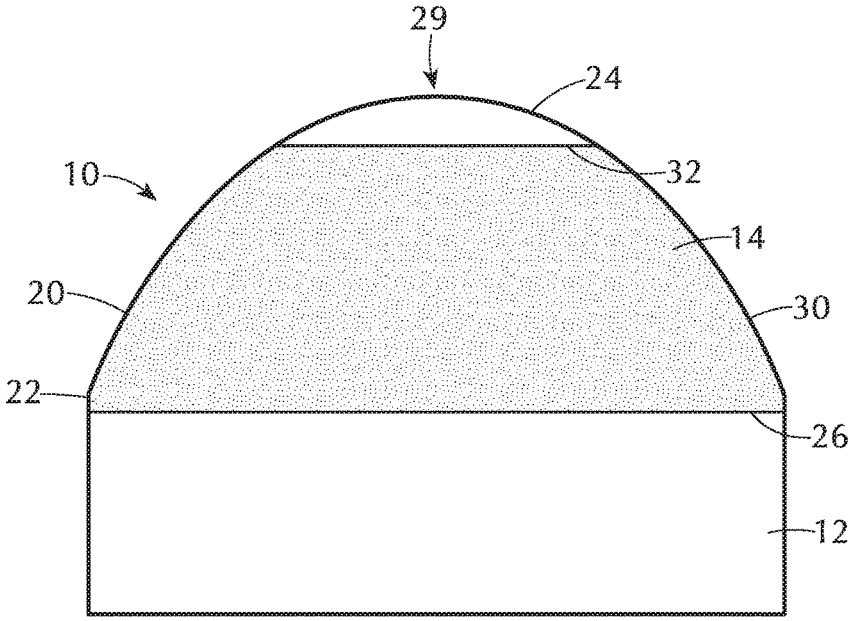
FIG. 16 is a side view of a superabrasive element according to an embodiment.

According to at least one embodiment, as illustrated in FIG. 16, superabrasive surface 20 of superabrasive table 14 may be non-planar. For example, polished surface 24 of superabrasive surface 20 may be non-planar and convex. As shown in FIG. 16, polished surface 24 may be substantially domed. Unpolished surface 30 of superabrasive surface 20 may be non-planar and convex. As illustrated in FIG. 16, unpolished surface 30 may be substantially convex and tapered (e.g., approaching a central axis of superabrasive element 10 as a function of height).

Figure 17:
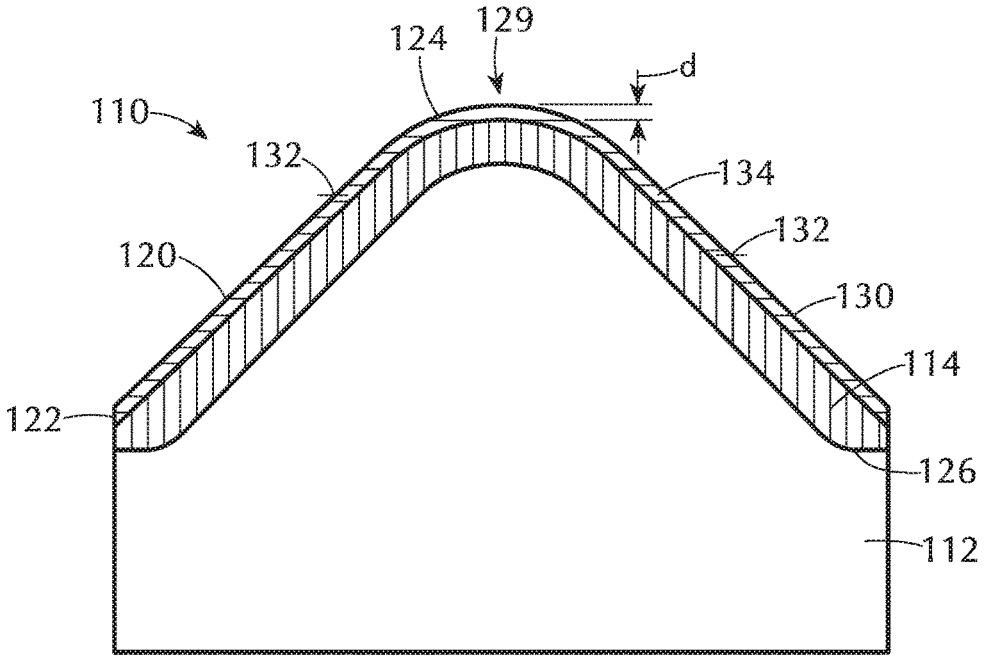
FIG. 17 is a cross-sectional side view of a superabrasive element according to an embodiment.

FIG. 17 illustrates a superabrasive element 110 according to at least one embodiment. As shown in FIG. 17, after HPHT processing, a metal-solvent catalyst may be leached from a superabrasive table to a selected depth using an acid leaching process or a gaseous leaching process as described in more detail below. For example, FIG. 17 shows a cross-sectional side view of superabrasive element 110 in which the metal-solvent catalyst is at least partially leached from a superabrasive table 114 to a selected depth "d", as measured from at least one of a superabrasive surface 120 and at least one superabrasive side surface 122, to form a leached region 134 that is depleted of the metal-solvent catalyst. For example, leached region 134 may generally contour superabrasive surface 120 and superabrasive side surface 122. Leached region 134 may extend along a selected length of the at least one superabrasive side surface 122. A residual amount of the metal-solvent catalyst may still be present in leached region 134 even after leaching. For example, the metal-solvent catalyst may comprise about 0.8 weight % to about 1.50 weight % and, more particularly, about 0.9 weight % to about 1.2 weight % of leached region 134. The leaching may be performed in a suitable acid (e.g., aqua regia, nitric acid, hydrofluoric acid, or combinations thereof) so that leached region 134 of superabrasive table 114 is substantially free of the metal-solvent catalyst. As a result of the metal-solvent catalyst being depleted from leached region 134, the at least partially leached PCD table may be relatively more thermally stable than prior to leaching.

According to at least one embodiment, superabrasive table 114 may be bonded to a substrate 112 along an interface 126. Interface 126 may extend along any suitable profile, without limitation. For example, as shown in FIG. 17, the profile of interface 126 may generally contour the profile of superabrasive surface 120 of superabrasive table 114. Superabrasive table 114 may include an apex 129 defined at an axially forward position of superabrasive table 114, a superabrasive surface 120, and at least one superabrasive side surface 122.

In some embodiments, the leaching to form leached region 134 may be accomplished by acid leaching superabrasive table 114 in a suitable acid, such as hydrochloric acid, nitric acid, hydrofluoric acid, aqua regia, or combinations thereof. In other embodiments, leached region 134 of superabrasive table 114 may be formed by exposing superabrasive table 114 to a gaseous leaching agent that is selected to substantially remove all of the metal-solvent catalyst from the interstitial regions of superabrasive table 114. A gaseous leaching agent may be selected from at least one halide gas, at least one inert gas, a gas from the decomposition of an ammonium halide salt, hydrogen gas, carbon monoxide gas, an acid gas, and mixtures thereof. For example, a gaseous leaching agent may include mixtures of a halogen gas (e.g., chlorine, fluorine, bromine, iodine, or combinations thereof) and an inert gas (e.g., argon, xenon, neon, krypton, radon, or combinations thereof). Other gaseous leaching agents include mixtures including hydrogen chloride gas, a reducing gas (e.g., carbon monoxide gas), gas from the decomposition of an ammonium salt (such as ammonium chloride which decomposes into chlorine gas, hydrogen gas and nitrogen gas), and mixtures of hydrogen gas and chlorine gas (which will form hydrogen chloride gas, in situ), acid gases such as hydrogen chloride gas, hydrochloric acid gas, hydrogen fluoride gas, and hydrofluoric acid gas. Any combination of any of the disclosed gases may be employed as the gaseous leaching agent. In an embodiment, a reaction chamber may be filled with a gaseous leaching agent of about 10 volume % to about 20 volume % chlorine with the balance being argon and the gaseous leaching agent being at an elevated temperature of at least about 300° C. to about 800° C. In another embodiment, the elevated temperature may be between at least about 600° C. to about 700° C. More specifically, in another embodiment, the elevated temperature may be at least about 650° C. to about 700° C.

In an embodiment, the leaching process may take place in a reaction chamber placed within a box furnace. For example, the reaction chamber may be flushed at room temperature with an inert gas, such as argon. The reaction chamber may be heated under a flow of argon at a rate of about 10° C./min until the desired elevated temperature is reached. According to an embodiment, once the reaction chamber reaches the desired temperature of, for example, 700° C., the gaseous leaching agent is introduced at a flow rate of 900 ml/min (measured at STP, 25° C., and 1 atm) to create the gaseous flow within the reaction chamber. The flow rate of the gaseous leaching agent may optionally be consistently maintained for the duration of the leaching reaction ranging from 15 minutes to 12 hours, depending on reaction conditions (i.e., the temperature selected, gaseous leaching agent used, the selected leach depth desired, etc.).

Additional details about gaseous leaching processes for leaching PCD elements are disclosed in U.S. application Ser. No. 13/324,237, the disclosure of which is incorporated herein, in its entirety, by this reference.

Following leaching and/or prior to leaching, at least a portion of superabrasive surface 120 of superabrasive table 114, such as a central, apical region, may be polished. For example, as shown in FIG. 17, superabrasive table 114 may be polished to yield a polished surface 124, an unpolished surface 130, and a polished interface 132. According to various embodiments, polished surface 124 may be non-planar and arcuate. As shown in FIG. 17, polished surface 124 may be substantially domed. According to at least one embodiment, at least some portions of superabrasive table 114 surrounding polished surface 124 may not be polished.

Unpolished surface 130 may not be polished and may surround polished surface 124. According to various embodiments, unpolished surface 130 may be non-planar. For example, as shown in FIG. 17, unpolished surface 130 may be substantially conical.

Polished interface 132 may extend along any suitable profile, without limitation. For example, polished interface 132 may be substantially linear or non-linear. In some embodiments, polished interface 132 may vary along an arcuate or undulating path (see, e.g., polished interface 32 illustrated in FIGS. 1, 2, and 9-16). For example, a height of unpolished interface 132 may be greater on one side (or a certain circumferential position) of superabrasive element 110 than another side (or another circumferential position) of superabrasive element 110. Any of the embodiments contemplated herein may be employed in combination with at least partial leaching of a portion of a polished surface and/or an unpolished surface without limitation.

Figure 18:
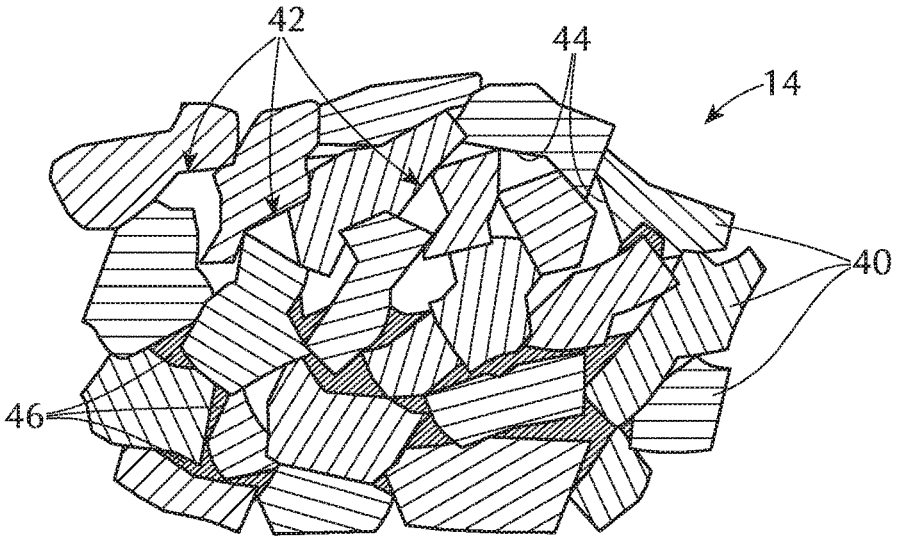
FIG. 18 is a magnified cross-sectional side view of a portion of the superabrasive table according to an embodiment.

FIG. 18 is a magnified cross-sectional side view of a portion of the superabrasive table 114 illustrated in FIG. 17. As shown in FIG. 18, superabrasive table 114 may comprise bonded superabrasive grains 40 and interstitial regions 42 between superabrasive grains 40 defined by grain surfaces 44. Superabrasive grains 40 may comprise grains formed of any suitable superabrasive material, including, for example, diamond grains. At least some of superabrasive grains 40 may be bonded to one or more adjacent superabrasive grains 40, forming a polycrystalline diamond matrix (e.g., polycrystalline diamond matrix).

An interstitial material 46 may be disposed in at least some of interstitial regions 42. Interstitial material 46 may comprise, for example, a metal-solvent catalyst, tungsten, and/or tungsten carbide. As shown in FIG. 18, interstitial material 46 may not be present in at least some of interstitial regions 42. At least a portion of interstitial material 46 may be removed from at least some of interstitial regions 42 during a leaching procedure. For example, a substantial portion of interstitial material 46 may be removed from leached region 134 during a leaching procedure. Additionally, interstitial material 46 may remain in a second volume following a leaching procedure.

In some examples, interstitial material 46 may be removed from table 114 to a depth that improves the performance and heat resistance of a surface of superabrasive table 114 to a desired degree. In some embodiments, interstitial material 46 may be removed from superabrasive table 114 to a practical limit. In order to remove interstitial material 46 from superabrasive table 114 to a depth beyond the practical limit, for example, significantly more time, temperature, and/or body force may be required. In some embodiments, interstitial material 46 may be removed from superabrasive table 114 to a practical limit where interstitial material remains in at least a portion of superabrasive table 114. In various embodiments, superabrasive table 114 may be fully leached so that interstitial material 46 is substantially removed from a substantial portion of superabrasive table 114. In at least one embodiment, interstitial material 46 may be leached from a superabrasive material, such as a PCD material in superabrasive table 114, by exposing the superabrasive material to a suitable leaching agent. Interstitial material 46 may include a metal-solvent catalyst, such as cobalt.

Relatively less concentrated and corrosive solutions may be inhibited from leaching a PCD article at a sufficient rate. In various embodiments, at least a portion of a superabrasive material and/or the leaching agent may be heated (e.g., to a temperature greater than approximately 50° C.) during leaching. According to additional embodiments, at least a portion of a superabrasive material and a leaching agent may be exposed to at least one of an electric current, microwave radiation, and/or ultrasonic energy. By exposing at least a portion of a superabrasive material to an electric current, microwave radiation, and/or high frequency ultrasonic energy as the superabrasive material is exposed to a leaching agent, the rate at which the superabrasive material is leached and/or the depth to which the superabrasive material is leached may be increased.

Figure 19:
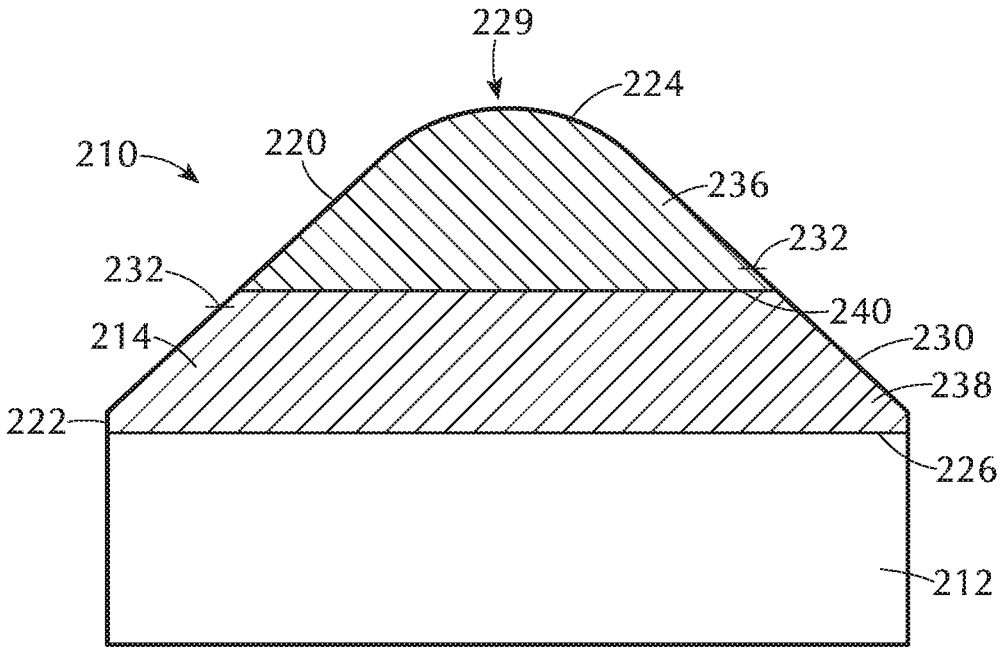
FIG. 19 is a cross-sectional side view of a superabrasive element according to an embodiment.

FIG. 19 illustrates an embodiment in which a superabrasive table 214 of a superabrasive element 210 comprises at least two layers of polycrystalline diamond. According to at least one embodiment, superabrasive table 214 may be bonded to a substrate 212 at an interface 226. Superabrasive table 214 may comprise an apex 229 defined at an axially forward position of superabrasive table 314, a superabrasive surface 220, and at least one superabrasive side surface 222.

As shown in FIG. 19, superabrasive table 214 may include a first layer 236 and a second layer 238 disposed between first layer 236 and substrate 212. The geometry of first layer 236 may define a substantially planar superabrasive interface 240 between first layer 236 and underlying second layer 238. In the illustrated embodiment, superabrasive interface 240 is substantially located below a polished surface 224. However, in other embodiments, at least a portion of polished surface 224 may extend past superabrasive interface 240 such that at least the portion of polished surface 224 is formed on second layer 238. While superabrasive interface 240 is illustrated as being substantially planar, in some embodiments, the boundary between first layer 236 and underlying second layer 238 may be non-planar (e.g., three-dimensionally domed, dimpled, hemispherical, conical, frustoconical, pyramidal, spherical, cubic, polyhedral, combinations thereof, or any other non-planar, three-dimensional shape; or cross-sectionally zig-zagged, stepped, arcuate, undulating, sinusoidal, combinations thereof, or any other non-planar cross-sectional configuration).

It should be noted that when one or more phosphorus materials and/or other alloying element(s) are used to form superabrasive table 214 (either in a powder form and/or alloyed with the at least one Group VIII metal), the alloy may be substantially homogenous and the concentration of the phosphorus and/or other alloying element(s) may be substantially uniform throughout superabrasive table 214. For example, in an embodiment, the alloy may include almost entirely $Co_2P$ when the at least one Group VIII metal is cobalt and the one or more phosphorus materials includes only phosphorus; the alloy may include almost entirely $Fe_3P$ and/or $Fe_2P$ when the at least one Group VIII metal is iron and the one or more phosphorus materials includes only phosphorus; or the alloy may include almost entirely $Ni_3P$ and/or $Ni_5P_2$ when the at least one Group VIII metal is nickel and the one or more phosphorus materials includes only phosphorus.

Alternatively, superabrasive table 214 may be formed from a first diamond powder containing the one or more phosphorus materials and/or other alloying element(s) and a second diamond powder that is substantially free of the one or more phosphorus materials and/or other alloying element(s). The first diamond powder and the second diamond powder may be positioned proximate to a substrate to form a first layer including the first diamond powder and a second layer including the second diamond powder, the second layer being disposed between the first layer and the substrate. The resulting superabrasive table 214 may include a first layer 236 including the alloy in the interstitial regions thereof, and a second layer 238 that is substantially free of the alloy in the interstitial regions thereof. In some embodiments, first layer 236 may be adjacent to polished surface 224 and second layer 238 may be disposed away from polished surface 224. Details about properties that superabrasive table 214 may exhibit are disclosed in U.S. application Ser. No. 14/304,631, the disclosure of which is incorporated herein, in its entirety, by this reference.

When an HPHT sintering pressure is greater than about 7.5 GPa cell pressure, optionally in combination with the average diamond grain size being less than about 30 μm, any portion of superabrasive table 214 (prior to being leached) defined collectively by the bonded diamond grains and the alloy may exhibit a coercivity of about 115 Oe or more and the alloy content in superabrasive table 214 may be less than about 7.5% by weight as indicated by a specific magnetic saturation of about 15 $G \cdot cm^3/g$ or less. In another embodiment, the coercivity may be about 115 Oe to about 250 Oe and the specific magnetic saturation of superabrasive table 214 (prior to being leached) may be greater than 0 $G \cdot cm^3/g$ to about 15 $G \cdot cm^3/g$. In another embodiment, the coercivity may be about 115 Oe to about 175 Oe and the specific magnetic saturation of superabrasive table 214 may be about 5 $G \cdot cm^3/g$ to about 15 $G \cdot cm^3/g$. In yet another embodiment, the coercivity of superabrasive table 214 (prior to being leached) may be about 155 Oe to about 175 Oe and the specific magnetic saturation of first layer 136 may be about 10 $G \cdot cm^3/g$ to about 15 $G \cdot cm^3/g$. The specific permeability (i.e., the ratio of specific magnetic saturation to coercivity) of superabrasive table 214 may be about 0.10 $G \cdot cm^3/g \cdot Oe$ or less, such as about 0.060 $G \cdot cm^3/g \cdot Oe$ to about 0.090 $G \cdot cm^3/g \cdot Oe$. In some embodiments, the average grain size of the bonded diamond grains may be less than about 30 μm and the alloy content in superabrasive table 214 (prior to being leached) may be less than about 7.5% by weight (e.g., about 1% to about 6% by weight, about 3% to about 6% by weight, or about 1% to about 3% by weight). Additionally, details about magnetic properties that superabrasive table 214 may exhibit are disclosed in U.S. Pat. No. 7,866,418, the disclosure of which is incorporated herein, in its entirety, by this reference.

At least a portion of superabrasive surface 220 of superabrasive table 214, such as a central, apical region, may be polished. For example, as shown in FIG. 19, superabrasive table 214 may be polished to yield a polished surface 224, an unpolished surface 230, and a polished interface 232. According to various embodiments, polished surface 224 may be non-planar and arcuate. As shown in FIG. 19, polished surface 224 may be substantially domed. According to at least one embodiment, at least some portions of superabrasive table 214 surrounding polished surface 224 may not be polished. Unpolished surface 230 may not be polished and may surround polished surface 224. According to various embodiments, unpolished surface 230 may be non-planar. For example, as shown in FIG. 19, unpolished surface 230 may be substantially conical. Polished interface 232 may extend along any suitable profile, without limitation. For example, polished interface 232 may be substantially linear or non-linear. In some embodiments, polished interface 232 may vary along an arcuate or undulating path. For example, a height of unpolished interface 232 may be greater on one side (or a certain circumferential position) of superabrasive element 210 than another side (or another circumferential position) of superabrasive element 210. According to at least one embodiment, as shown in FIG. 19, polished surface 224 may be disposed on first layer 236 and may extend to second layer 238. According to other embodiments, polished surface 224 may be disposed on first layer 236 only or may extend beyond superabrasive interface 240 to second layer 238. Any layering configuration, such as those disclosed in U.S. Pat. No. 8,727,046, the disclosure of which is incorporated herein, in its entirety, by this reference, may be utilized in superabrasive elements or PDCs according to the Present Application.

Figure 20:
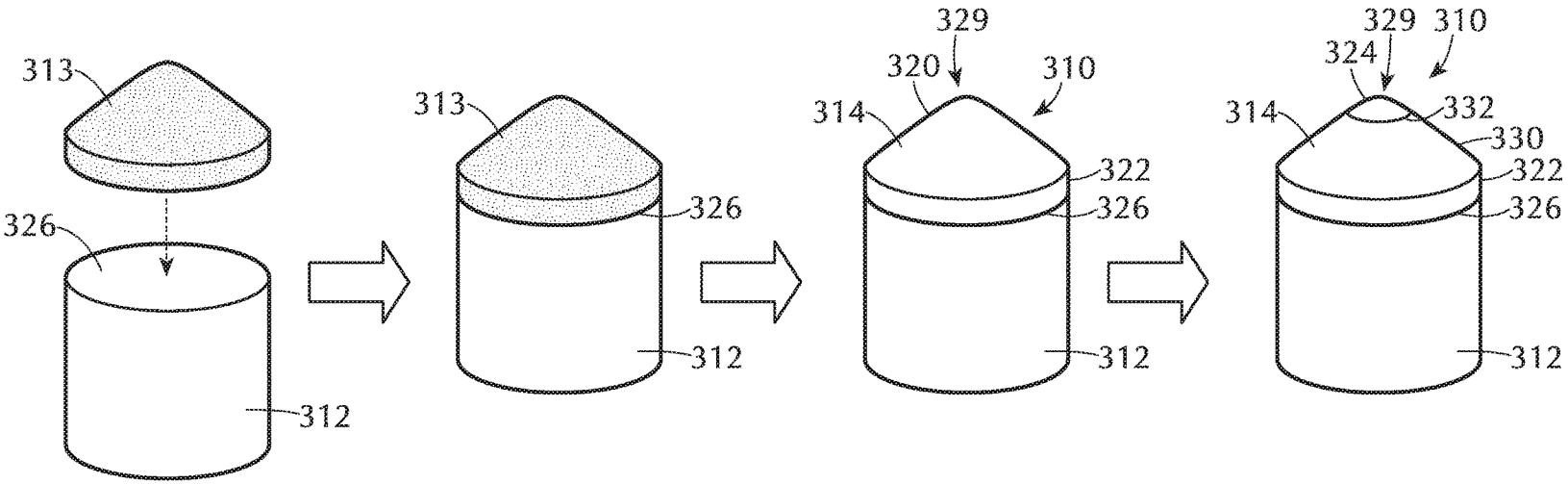
FIG. 20 is a schematic illustration of a method of fabricating a superabrasive element according to an embodiment.

FIG. 20 shows a schematic illustration of a method of fabricating a superabrasive element 310 according to at least one embodiment. In many applications, it may be desirable to form superabrasive element 310 on a substrate as a superabrasive table or a superabrasive volume. For example, FIG. 20 illustrates a method of fabricating any of the superabrasive tables disclosed herein on a substrate to form a superabrasive element (see, e.g., superabrasive elements 10, each comprising a substrate 12 and a superabrasive table 14, as illustrated in FIGS. 1-16). With reference to FIG. 20, at least one layer or region of diamond particles 313 may be positioned adjacent to a suitable substrate 312 at an interface 326. Substrate 312 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in an embodiment, substrate 312 comprises cobalt-cemented tungsten carbide.

Diamond particles 313 and substrate 312 may be subjected to an HPHT process using any HPHT conditions disclosed herein to form a superabrasive element 310. Superabrasive element 310 so formed may include a superabrasive table 314 that comprises PCD, according to any of the PCD embodiments disclosed herein, bonded to substrate 312 at interface 326. If substrate 312 includes a metal-solvent catalyst, the metal-solvent catalyst may liquefy and infiltrate diamond particles 313 during the HPHT process to promote growth between adjacent diamond particles of diamond particles 313 to form superabrasive table 314 comprised of a body of directly bonded-together diamond grains having the infiltrated metal-solvent catalyst interstitially disposed between bonded diamond grains. For example, if substrate 312 is a cobalt-cemented tungsten carbide substrate, cobalt from substrate 312 may be liquefied and infiltrate diamond particles 313 to catalyze formation of superabrasive table 314 during the HPHT process.

Superabrasive table 314 may include an apex 329 defined at an axially forward position of superabrasive table 314, a superabrasive surface 320, and at least one superabrasive side surface 322. Any of the superabrasive surface 320 or superabrasive side surface 322 may function as a working or bearing surface during use. Although FIG. 20 shows superabrasive surface 320 as generally conical with a domed upper tip region, superabrasive surface 320 may be concave, convex, or another non-planar geometry.

According to various embodiments, at least a portion of the surface of superabrasive table 314, such as a central, apical region, may be polished. For example, as shown in FIG. 20, a polished surface 324 of superabrasive table 314 may be polished. According to at least one embodiment, polished surface 324 may comprise a working surface of superabrasive table 314. According to various embodiments, polished surface 324 may be substantially planar or non-planar (e.g., three-dimensionally domed, dimpled, hemispherical, conical, frustoconical, pyramidal, spherical, cubic, polyhedral, combinations thereof, or any other non-planar, three-dimensional shape; or cross-sectionally zigzagged, stepped, arcuate, undulating, sinusoidal, combinations thereof, or any other non-planar cross-sectional configuration). For example, polished surface 324 of superabrasive surface 320 may be non-planar and arcuate. As shown in FIG. 20, polished surface 324 may be substantially domed.

In some embodiments, only selected portions of the surface of superabrasive table 314 may be polished. For example, some portions of superabrasive table 314 substantially surrounding polished surface 324 may not be polished and/or may have a greater surface roughness than polished surface 324. An unpolished surface 330 substantially surrounding polished surface 324 may not be polished. According to various embodiments, unpolished surface 330 may surround most of or a majority of polished surface 324. Unpolished surface 330 may be substantially planar or non-planar (e.g., three-dimensionally domed, dimpled, hemispherical, conical, frustoconical, pyramidal, spherical, cubic, polyhedral, combinations thereof, or any other non-planar, three-dimensional shape; or cross-sectionally zigzagged, stepped, arcuate, undulating, sinusoidal, combinations thereof, or any other non-planar cross-sectional configuration). As illustrated in FIG. 20, unpolished surface 330 may be substantially conical. In some embodiments, unpolished surface 330 may not be a working surface. Unpolished surface 330 may be configured to be exposed to and/or in contact with a subterranean formation to a lesser extent than polished surface 324 during drilling.

According to various embodiments, polished surface 324 may be adjacent to unpolished surface 330 along a polished interface 332. Polished interface 332 may extend along any suitable profile, without limitation. For example, polished interface 332 may be positioned at a substantially constant height relative to apex 29 or may vary or undulate along a path (e.g., along a circumference of superabrasive table 314).

Figure 21:
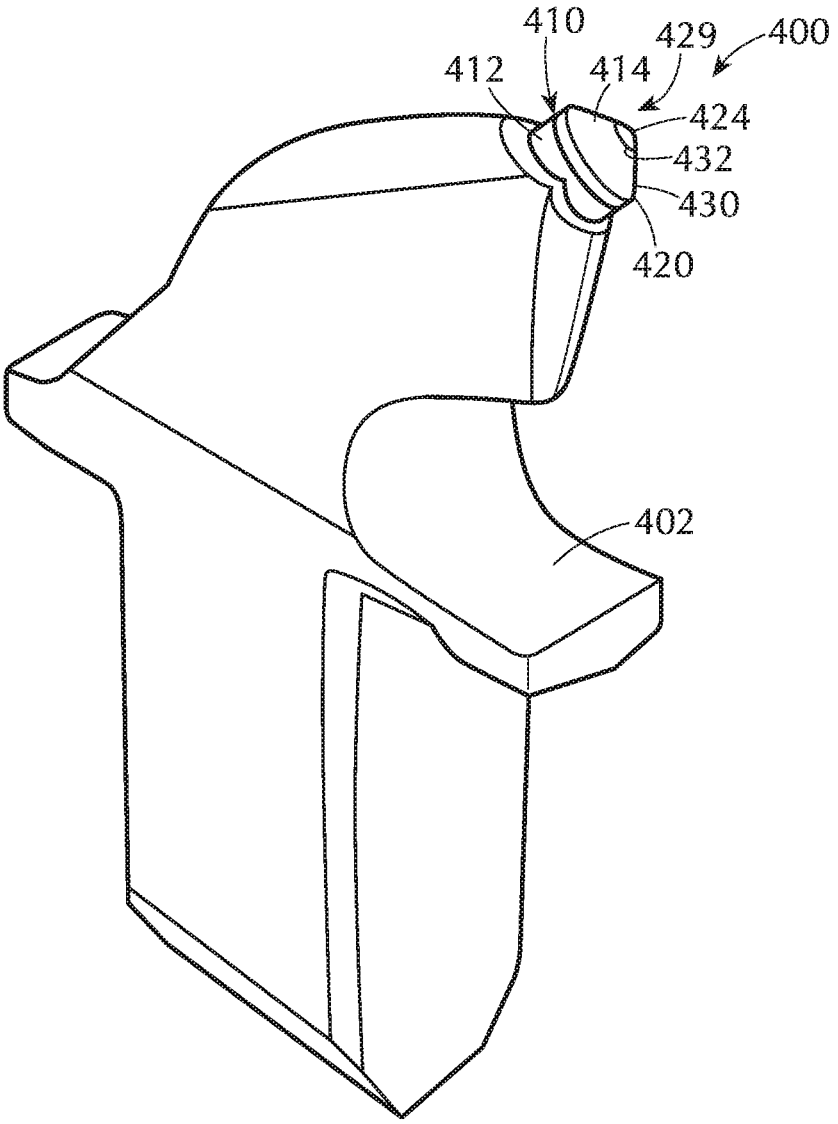
FIG. 21 is an isometric view of a cutting tool having a superabrasive element attached to a tool body according to an embodiment.

FIG. 21 is an isometric view of a cutting tool 400 having a superabrasive element 410 attached to a tool body 402 according to an embodiment. Tool body 402 may be any tool body as described in U.S. patent application Ser. No. 14/266,437, entitled "Cutting Tool Assemblies Including Superhard Working Surfaces, Material-Removing Machines Including Cutting Tool Assemblies, And Methods Of Use," filed on Apr. 30, 2014. In some embodiments, tool body 402 may be any pick body described in U.S. patent application Ser. No. 14/275,574, entitled "Shear Cutter Pick Milling System," filed on May 12, 2014. Furthermore, in at least one embodiment, tool body 402 may be any pick body described in U.S. patent application Ser. No. 14/273,360, entitled "Road-Removal System Employing Polycrystalline Diamond Compacts," filed on May 8, 2014. The disclosure of each of the foregoing U.S. patent applications is incorporated herein, in its entirety, by this reference.

One or more superabrasive elements 410 may be mounted to corresponding mounting portions defined in tool body 402 by, for example, brazing or press-fitting within a pocket or recess (e.g., pocket or recess 413 illustrated in FIG. 22) formed in tool body 402. Each superabrasive element 410 may be configured according to any of the embodiments disclosed or contemplated herein, such as, for example, the superabrasive element 10 shown in FIGS. 1-16. Each superabrasive element 410 may include a substrate 412 bonded to a superabrasive table 414 and an apex 429 defined at an axially forward position of superabrasive table 414. Each superabrasive table 414 may include a generally conical portion of superabrasive surface 420. According to various embodiments, each superabrasive surface may include a polished surface 424, an unpolished surface 430, and a polished interface 432. Polished surface 424 may be non-planar. For example, at least a portion of polished surface 424 may be substantially domed. Further, for example, at least a portion of unpolished surface 430 may be substantially conical.

At least a portion of superabrasive surface 420 of superabrasive table 414, such as a central, apical region, may be polished. For example, superabrasive table 414 may be polished to yield a polished surface 424, an unpolished surface 430, and a polished interface 432. According to various embodiments, polished surface 424 may be non-planar and arcuate. Polished surface 424 may be substantially domed. According to at least one embodiment, at least some portions of superabrasive table 414 surrounding polished surface 424 may not be polished and/or may have a greater surface roughness than polished surface 424. Unpolished surface 430 may not be polished and may substantially surround polished surface 424. According to various embodiments, unpolished surface 330 may surround most of or a majority of polished surface 324. According to various embodiments, unpolished surface 430 may be non-planar. For example, unpolished surface 430 may be substantially conical. Polished interface 432 may extend along any suitable profile, without limitation. For example, polished interface 432 may be substantially linear or non-linear. In some embodiments, polished interface 432 may vary along an arcuate or undulating path. For example, a height of unpolished interface 432 may be greater on one side (or a certain circumferential position) of superabrasive element 410 than another side (or another circumferential position) of superabrasive element 410. Any of the embodiments contemplated herein may be employed in combination with at least partial leaching of a portion of a polished surface and/or an unpolished surface without limitation.

Figure 22:
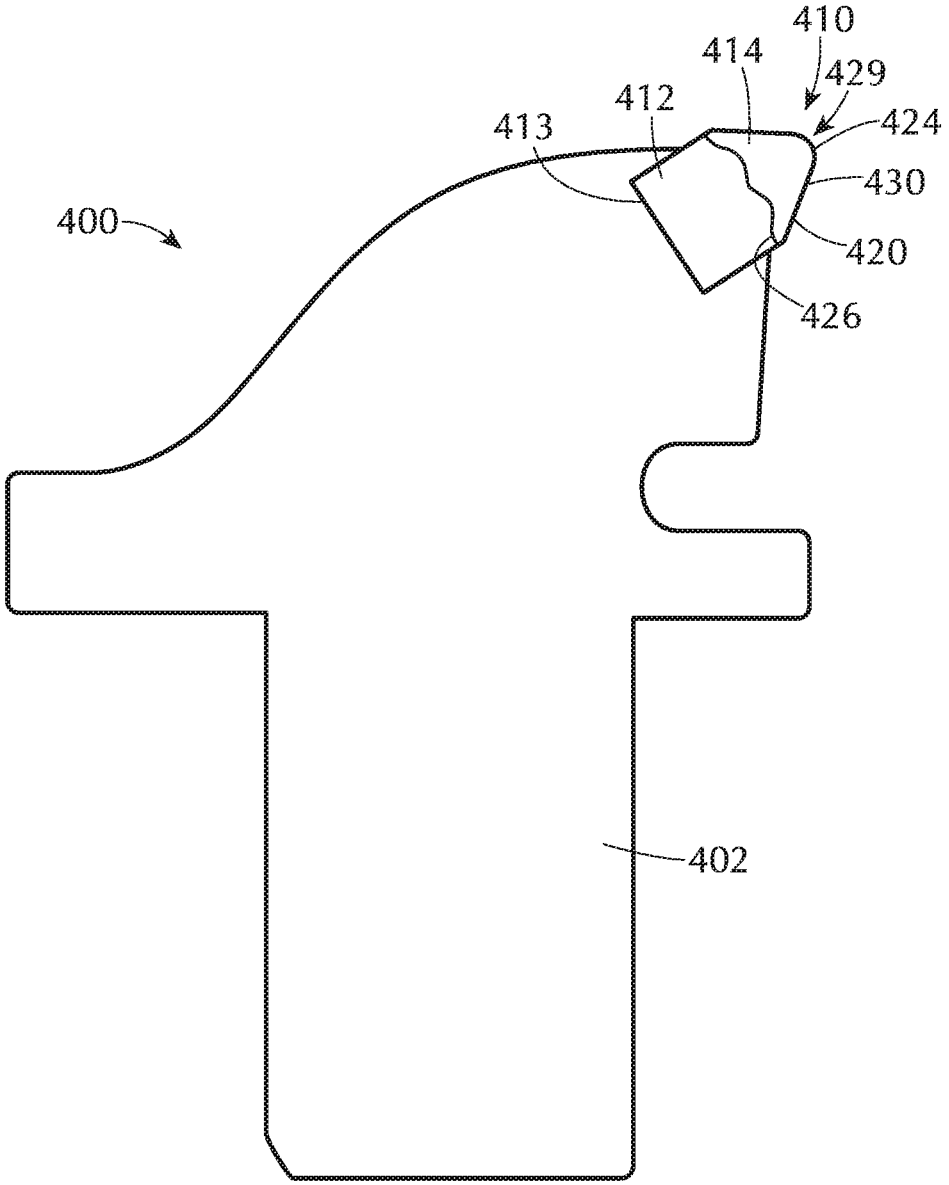
FIG. 22 is a cross-sectional view of a cutting tool according to an embodiment.

FIG. 22 is a cross-sectional side view of the cutting tool 400 illustrated in FIG. 21. In an embodiment, cutting tool 400 may include a tool body 402. One or more superabrasive elements 410 may be mounted to corresponding mounting portions formed in tool body 402 by, for example, brazing or press-fitting within a pocket or recess 413 defined in tool body 402. Each superabrasive element 410 may be configured according to any of the embodiments disclosed herein, such as, for example, the superabrasive element 10 shown in FIGS. 1-16. Each superabrasive element 410 may include a substrate 412 bonded to a superabrasive table 414. Substrate 412 may be bonded to superabrasive table 414 along an interface 426. According to at least one embodiment, interface 426 may comprise a substantially dimpled profile comprising two or more curved regions, as illustrated in FIG. 22. Superabrasive table 414 may include a generally conical superabrasive surface 420.

Figure 23:
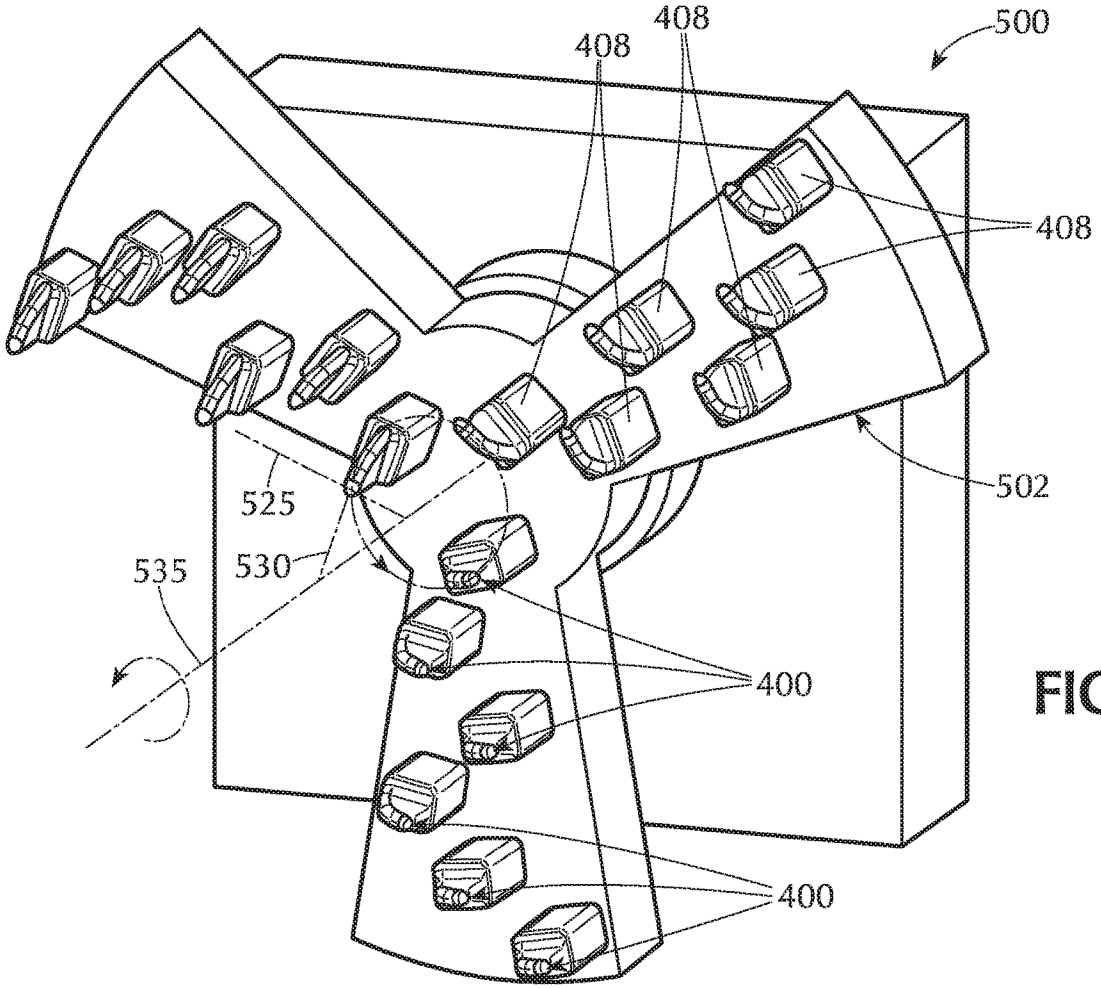
FIG. 23 is a schematic isometric view of a material-removal system according to an embodiment.

FIG. 23 illustrates a material-removal system 500 according to an embodiment. More specifically, material-removal system 500 may include a cutting head 502 that is rotatable about a rotational axis 535. Furthermore, cutting head 502 may include a plurality of cutting tools secured thereto. Specific arrangement of the cutting tools on cutting head 502 may vary from one embodiment to the next. For example, cutting head 502 may include cutting tools 400 secured thereto (see, e.g., cutting tool 400 illustrated in FIGS. 21 and 22).

In some examples, cutting head 502 may include multiple holders 408 that secure corresponding cutting tools 400 to cutting head 502. Holders 408 may be attached to or integrated with cutting head 502. In an embodiment, cutting tools 400 may be attached to cutting head 502 and may rotate together therewith about rotational axis 535. Additionally, as described above, as cutting head 502 rotates and advances toward and/or into the target material, cutting tools 400 may also advance toward and/or into the target material, thereby cutting into and/or failing the target material.

In an embodiment, cutting tools 400 may include corresponding superabrasive surfaces that may generally face in the direction of rotation of cutting head 502 and cutting tools 400 (as indicated by the arrow). Hence, the superabrasive surfaces and/or cutting ends of cutting tools 400 may engage and fail the target material as cutting head 502 rotates about rotational axis 535. Moreover, the superabrasive surface may have selected back and/or side rake angles.

In some embodiments, two or more cutting tools 400 may have different positions or locations from one another relative to rotational axis 535. In other words, two or more cutting tools 400 may have different radial spacing from one another. For example, some cutting tools 400 may be spaced farther away from rotational axis 535 than other cutting tools 400.

Figure 24:
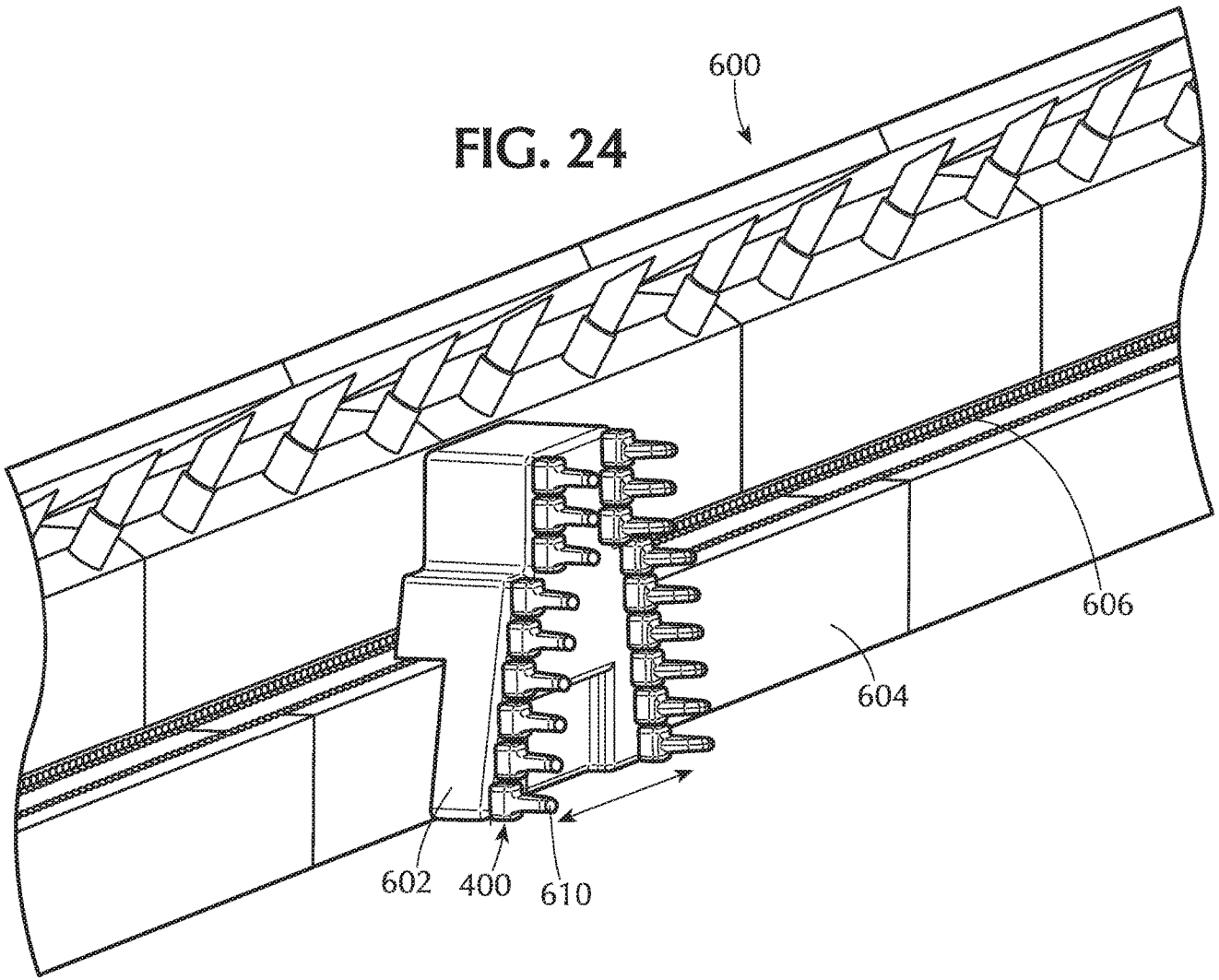
FIG. 24 is an isometric view of a long-wall material removal system according to at least one embodiment.

FIG. 24 illustrates a material-removal system 600 according to an embodiment. While in some embodiments a material-removal system may include a bore mining head or bore mining machine, which may bore into the target material, the present disclosure is not so limited. Specifically, for example, material-removal system 600 may be a long-wall material-removal system, such as a chain system, drum system, plow system, etc., that may move along a wall and may remove the target material therefrom during such movement. FIG. 24 illustrates a long-wall material-removal system 600 according to at least one embodiment. Except as otherwise described herein, material-removal system 600 and its materials, elements, or components may be similar to or the same as the material-removal system 500 (FIG. 23) and its corresponding materials, elements, and components. Furthermore, material-removal system 600 may include any cutting tool, superabrasive element, and/or combination thereof described herein.

In an embodiment, material-removal system 600 may include multiple cutting tools 400 (see, e.g., cutting tool 400 illustrated in FIGS. 21 and 22; not all labeled) mounted to a cutting head 602. Cutting head 602 may be advanced linearly and cutting tools 400 may engage, cut, scrape, or otherwise fail and/or remove target material during advancement of cutter head 602. In at least one embodiment, cutter head 602 may be slideably or movably mounted on an elongated support member 604 and may be advanced generally linearly along elongated support member 604 (e.g., in first and/or second directions, as indicated with arrows). In some embodiments, material-removal system 600 may include a chain 606 (or a similar movable attachment), which may be connected to cutter head 602 and to an advancement mechanism, such as a motor. In an embodiment, chain 606 may advance cutter head 602 in the first and/or second directions, thereby engaging the target material with cutting tools 400 and removing the target material.

In some embodiments, cutting tools 400 may include corresponding superabrasive elements 610 (not all labeled), which may engage the target material. In an example, at least some of superabrasive elements 610 may generally point or face in the direction of movement of cutter head 600. As mentioned above, cutter head 602 may move in the first and second directions along elongated support member 604. According to at least one embodiment, at least some of superabrasive elements 610 may generally face in the first direction, and at least some of superabrasive elements 610 may generally face in the second direction.

Figure 25:
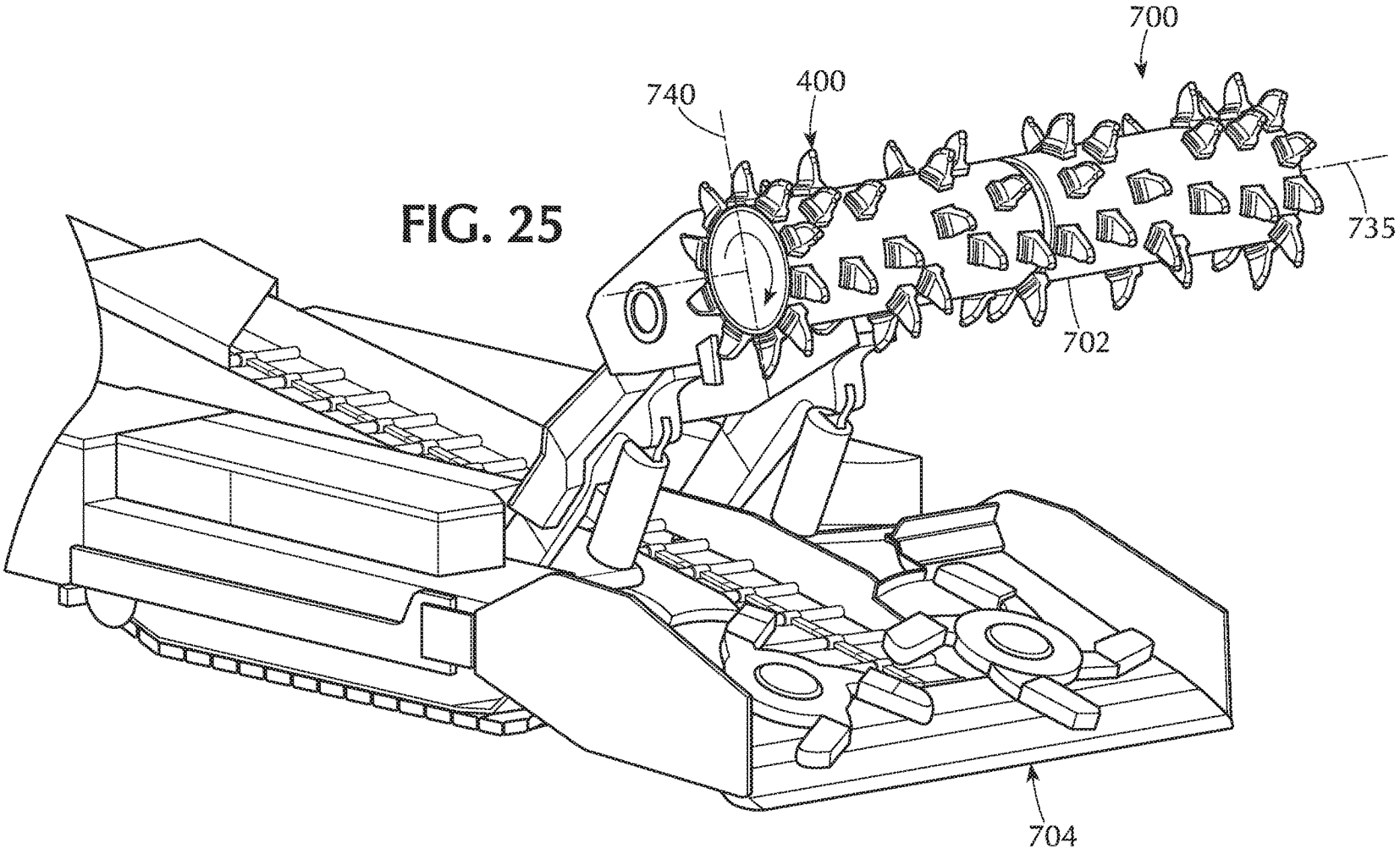
FIG. 25 is an isometric view of a material-removal system that includes a cutter head that may rotate about a rotational axis and/or move linearly along a vertical axis according to an embodiment.

FIG. 25 illustrates a material-removal system 700 according to at least one embodiment. Material-removal system 700 may produce linear movement and/or rotation of the cutting tools. Material-removal system 700 may include a cutter head 702 that may rotate about a rotational axis 735 and/or move at least partially vertically (e.g., generally radially in a direction 740 that is substantially perpendicular to rotational axis 735 or vertically with no radial movement). Except as otherwise described herein, material-removal system 700 and its materials, elements, or components may be similar to or the same as any of the material-removal systems 500, 600 (see FIGS. 23 and 24) and its corresponding materials, elements, and components. Furthermore, material-removal system 700 may include any cutting tool and/or combination of cutting tools described herein.

In an embodiment, cutting head 702 may include at least one cutting tool 400 secured thereto. For example, cutting head 702 may include multiple cutting tools 400 that generally extend outward and away from rotational axis 735. In some embodiments, cutting tools 400 may face generally in the direction of rotation.

In some examples, material-removal system 700 may include a material removal ramp 704. Failed target material may be swept or otherwise moved onto ramp 704 and may be removed from an operation site by material-removal system 700. It should be also appreciated that the cutting tools described herein may be mounted on any suitable cutting head or included in a material-removal system, and the specific examples of material-removal systems described herein are for illustrative purposes and are not intended to be limiting.

Figure 26:
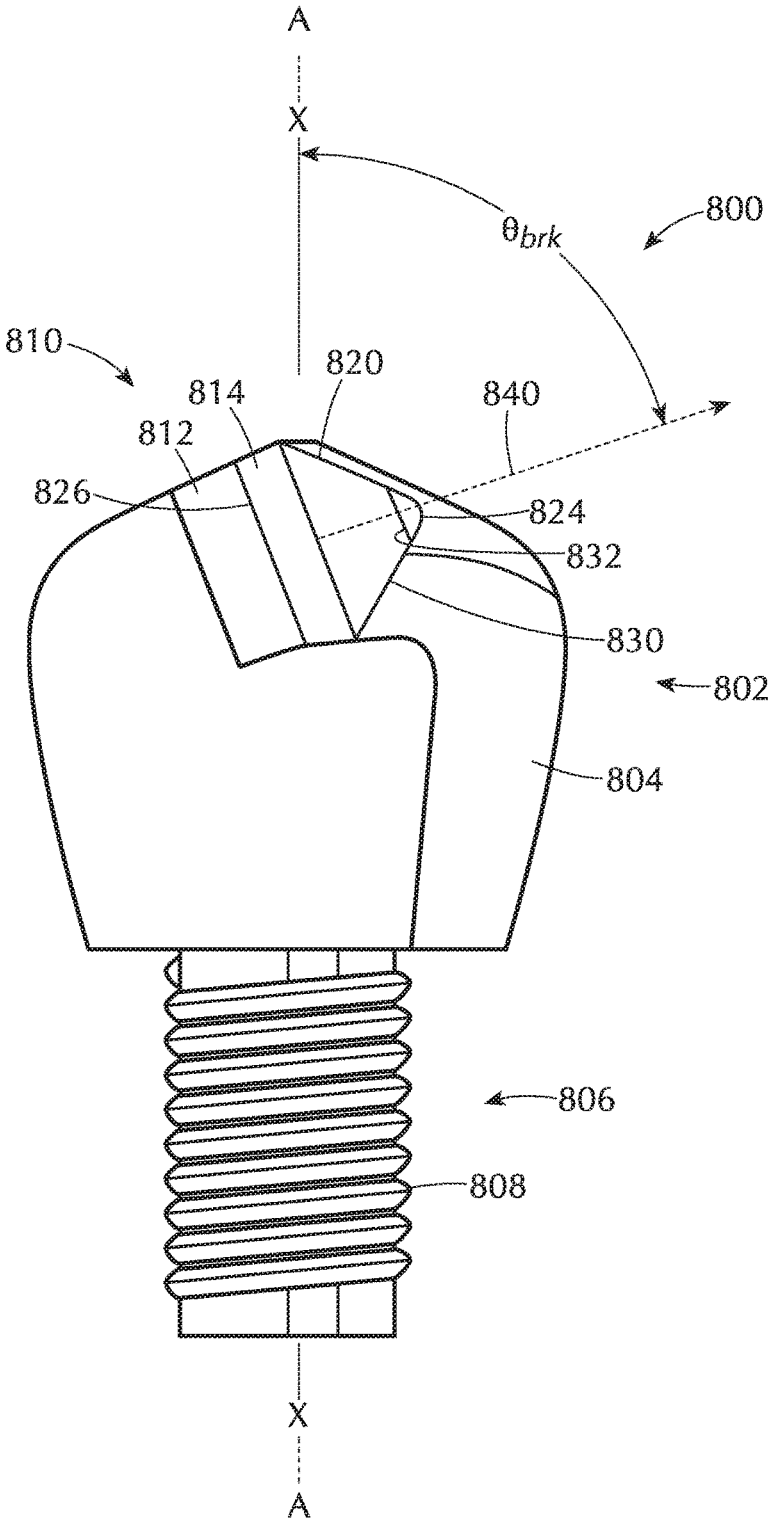
FIG. 26 is a side elevation view of a mining rotary drill bit that may employ one or more of the disclosed superabrasive elements.

FIG. 26 is a side elevation view of an embodiment of a mining rotary drill bit 800. Rotary drill bit 800 is suitably configured for drilling boreholes in a formation (i.e., configured as a roof drill bit), such as drilling boreholes in an unsupported roof of a tunnel in, for example, a coal mine. Rotary drill bit 800 includes a bit body 802 that may be formed from a machinable steel, a hardfaced bit body, and an infiltrated-carbide material (e.g., infiltrated tungsten carbide or so-called "matrix" material). Bit body 802 includes a head portion 804 and a shaft portion 806 extending from head portion 804. Shaft portion 806 may include threads 808 and/or another suitable coupling portion configured for connecting rotary drill bit 800 to a drilling machine (not shown) operable to rotate rotary drill bit 800 about a rotational axis A and apply a thrust load along rotational axis A to drill a borehole in a formation.

One or more superabrasive elements 810 may be mounted to corresponding mounting portions formed in head portion 804 by, for example, brazing or press-fitting within a pocket or recess (not shown) formed in bit body 802. Each superabrasive element 810 may be configured according to any of the embodiments disclosed herein, such as the superabrasive element 10 shown in FIGS. 1-16. Each superabrasive element 810 includes a substrate 812 bonded to a superabrasive table 814. Each superabrasive table 814 may each include a generally conical superabrasive surface 820. According to various embodiments, each superabrasive surface may include a polished surface 824, an unpolished surface 830, and a polished interface 832. Polished surface 824 may be non-planar. For example, polished surface 824 may be substantially domed. For example, unpolished surface 830 may be substantially conical. Polished interface 832 may be generally linear or non-linear.

A central axis 840 of each superabrasive element 810 may be oriented in selected directions, and further oriented at a selected back rake angle $\theta_{brk}$ and at a selected side rake angle measured between central axis 840 and a direction tangent to the rotation of superabrasive element 810, which may be best illustrated by a top view of drill bit 800. Each superabrasive element 810 may be tilted about a reference axis by back rake angle $\theta_{brk}$ with back rake angle $\theta_{brk}$ being the angle between central axis 840 and a reference plane x-x. The reference axis is generally perpendicular to rotational axis A and lies in reference plane x-x with rotational axis A. In an embodiment, back rake angle $\theta_{brk}$ may be about 5 degrees to about 35 degrees, and more particularly, about 10 degrees to about 25 degrees.

Figure 27:
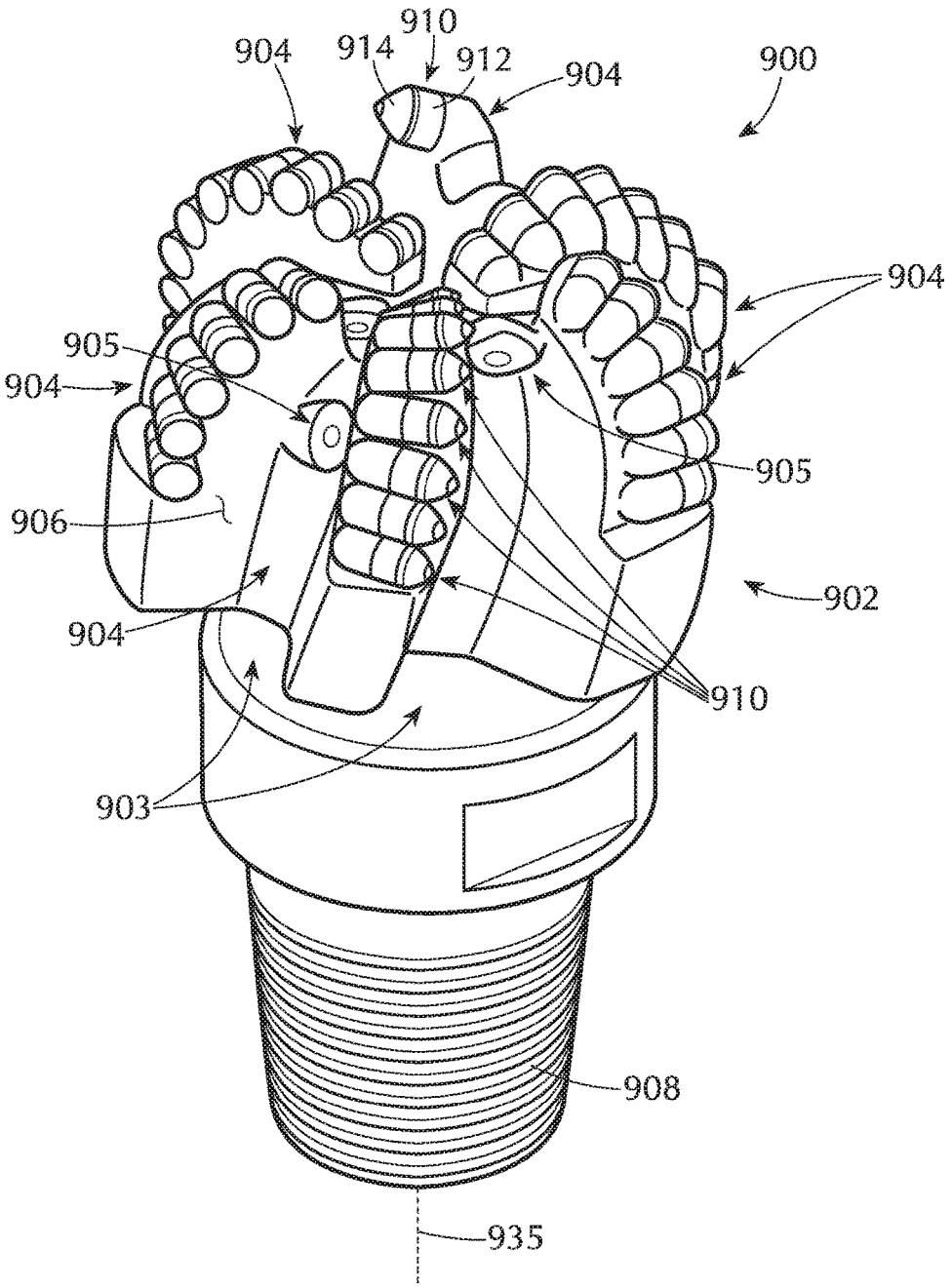
FIG. 27 is an isometric view of an embodiment of a rotary drill bit that may employ one or more of the disclosed superabrasive elements.

FIG. 27 is an isometric view of an embodiment of a rotary drill bit 900 for use in subterranean drilling applications, such as oil and gas exploration. Rotary drill bit 900 includes at least one superabrasive element and/or PDC configured according to any of the previously described embodiments. Rotary drill bit 900 comprises a bit body 902 that includes radially and longitudinally extending blades 904 with leading faces 906, and a threaded pin connection 908 for connecting bit body 902 to a drilling string. Bit body 902 defines a leading end structure for drilling into a subterranean formation by rotation about a longitudinal axis 916 and application of weight-on-bit. At least one superabrasive element, configured according to any of the previously described embodiments (e.g., the superabrasive element 10 shown in FIGS. 1 and 2), may be affixed to bit body 902. A plurality of superabrasive elements 910 may be secured to blades 904. For example, each superabrasive element 910 may include a superabrasive table 914 bonded to a substrate 912. More generally, superabrasive elements 910 may comprise any superabrasive element disclosed herein, without limitation. In addition, if desired, in some embodiments, a number of the superabrasive elements 910 mounted to rotary drill 900 may be conventional in construction. Also, circumferentially adjacent blades 904 define so-called junk slots 903 therebetween. Additionally, rotary drill bit 900 may include a plurality of nozzle cavities 905 for communicating drilling fluid from the interior of rotary drill bit 900 to superabrasive elements 910.

Figure 28:
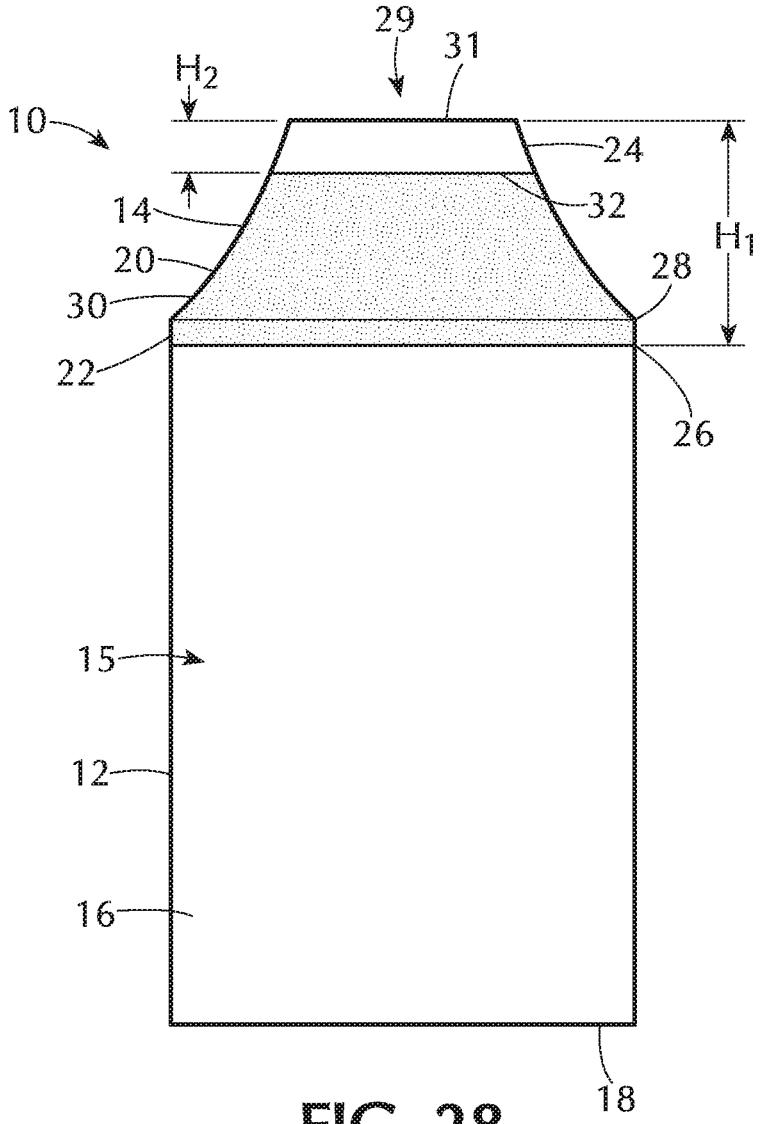
FIG. 28 is a side view of a superabrasive element according to an embodiment.

FIG. 28 is a side view of a superabrasive element 10 according to at least one embodiment. Superabrasive element 10 may comprise a superabrasive table 14 affixed to a substrate 12 at an interface 26. According to various embodiments, as illustrated in FIG. 28, a superabrasive surface 20 of superabrasive table 14 may comprise a central, planar portion surrounded by a concave, non-planar portion. Superabrasive table 14 may be polished to yield various configurations of a polished surface 24, unpolished surfaces 30 and 31, and a polished interface 32. According to various embodiments, a portion of the concave, non-planar portion of superabrasive surface 20 surrounding the central, planar portion may be polished. For example, as shown in FIG. 28, a polished surface 24 of superabrasive table 14 may be polished. In some embodiments, only selected portions of the surface of superabrasive table 14 may be polished. For example, a central, planar portion of superabrasive table and some portions of superabrasive table 14 circumferentially surrounding polished surface 24 may not be polished. According to at least one embodiment, an unpolished surface 30 surrounding polished surface 24 may not be polished and/or may have a greater surface roughness than polished surface 24. According to further embodiments, an unpolished surface 31 located at a central, planar position on superabrasive table 14 may be surrounded by polished surface 24; unpolished surface 31 may not be polished and/or which may have a greater surface roughness than polished surface 24.

The distance from interface 26 to apex 29 of superabrasive table 14 may be defined by a superabrasive table height $H_1$. At a certain circumferential position, the distance from polished interface 32 to apex 29 of superabrasive table 14 may be defined by a polished height $H_2$. Polished height $H_2$ may vary along the path of polished interface 32 (e.g., an arcuate or undulating path).

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall open ended and have the same meaning as the word "comprising" and variants thereof (e.g., "comprise" and "comprises").

What is claimed is:

1. A superabrasive element comprising:
a substrate; and
a superabrasive table bonded to the substrate, the superabrasive table comprising:
a polished surface having a polished finish, the polished surface extending over at least a central, apical region of the superabrasive table; and
an unpolished surface having an unpolished finish, the unpolished surface surrounding a majority of the polished surface, wherein at least a portion of the unpolished surface of the superabrasive table is substantially arcuate and convex.

2. The superabrasive element according to claim 1, wherein at least a portion of the unpolished surface of the superabrasive table is substantially conical.

3. The superabrasive element according to claim 1, wherein the central, apical region is domed.

4. The superabrasive element according to claim 1, wherein the central, apical region is at least partially leached.

5. The superabrasive element according to claim 1, wherein the central, apical region of the superabrasive table is substantially arcuate.

6. A method of manufacturing a superabrasive element, the method comprising:
providing a superabrasive element comprising:
a substrate; and
a superabrasive table bonded to the substrate;
polishing at least a central, apical region of the superabrasive table to form a polished surface, without polishing an unpolished surface of the superabrasive table, the unpolished surface surrounding a majority of the polished surface, wherein at least a portion of the unpolished surface of the superabrasive table is substantially arcuate and convex.

7. The method of manufacturing a superabrasive element according to claim 6, wherein at least a portion of the polished surface of the superabrasive table is substantially arcuate.

8. The method of manufacturing a superabrasive element according to claim 6, wherein at least a portion of the unpolished surface of the superabrasive table is substantially conical.

9. The method of manufacturing a superabrasive element according to claim 6, wherein at least a portion of the unpolished surface of the superabrasive table is non-planar.

10. The method of manufacturing a superabrasive element according to claim 6, wherein polishing at least the central, apical region comprises grinding, lapping, chemical polishing, laser polishing, ion beam polishing, or combinations thereof.

11. The method of manufacturing a superabrasive element according to claim 10, wherein polishing at least the central, apical region comprises grinding or lapping without coolant.

12. The method of manufacturing a superabrasive element according to claim 6, further comprising leaching at least the central, apical region.

13. The method of manufacturing a superabrasive element according to claim 6, wherein providing the superabrasive element comprises providing the superabrasive table with a domed, central, apical region.

14. The method of manufacturing a superabrasive element according to claim 13, wherein providing the superabrasive element comprises providing the superabrasive table with a conical surface surrounding the domed, central, apical region.

* * * * *